US009552976B2

(12) United States Patent
Boroczki et al.

(10) Patent No.: US 9,552,976 B2
(45) Date of Patent: Jan. 24, 2017

(54) OPTIMIZED HID ARC TUBE GEOMETRY

(71) Applicant: General Electric Company, Schenectady, NY (US)

(72) Inventors: Agoston Boroczki, Budapest (HU); Peter Horváth, Budapest (HU)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/274,152

(22) Filed: May 9, 2014

(65) Prior Publication Data

US 2014/0333200 A1 Nov. 13, 2014

Related U.S. Application Data

(60) Provisional application No. 61/821,765, filed on May 10, 2013.

(51) Int. Cl.
*H01J 61/33* (2006.01)
*H01J 61/30* (2006.01)

(52) U.S. Cl.
CPC ..... *H01J 61/33* (2013.01); *H01J 61/302* (2013.01)

(58) Field of Classification Search
USPC ..... 313/634, 573, 625
See application file for complete search history.

(56) References Cited

U.S. PATENT DOCUMENTS

| | | | |
|---|---|---|---|
| 3,858,078 | A | 12/1974 | Koury |
| 3,883,766 | A | 5/1975 | Fohl |
| 4,278,910 | A | 7/1981 | Keeffe et al. |
| 4,538,091 | A | 8/1985 | Lewis et al. |
| 4,540,373 | A | 9/1985 | Rothwell et al. |
| 4,643,690 | A | 2/1987 | Caruso et al. |
| 4,704,093 | A | 11/1987 | Morris |
| 4,808,876 | A | 2/1989 | French et al. |
| 4,910,432 | A | 3/1990 | Brown et al. |
| 4,999,145 | A | 3/1991 | Thibodeau |
| 5,101,134 | A | 3/1992 | Rothwell, Jr. et al. |
| 5,539,271 | A | 7/1996 | Sulcs et al. |
| 5,936,351 | A | 8/1999 | Lang |
| 5,986,402 | A | 11/1999 | Narita et al. |
| 5,993,725 | A | 11/1999 | Zuk et al. |
| 6,027,389 | A | 2/2000 | Miyazawa et al. |
| 6,515,406 | B1 | 2/2003 | Kai et al. |
| 6,555,962 | B1 | 4/2003 | Jackson et al. |

(Continued)

FOREIGN PATENT DOCUMENTS

| | | |
|---|---|---|
| EP | 0331154 A1 | 9/1989 |
| EP | 0550985 A1 | 7/1993 |

(Continued)

*Primary Examiner* — Ashok Patel

(74) *Attorney, Agent, or Firm* — GE Global Patent Operation; Peter T. DiMauro

(57) ABSTRACT

The geometry of a High Intensity Discharge (HID) arc tube is controlled to improve lamp color control and temperature distribution. In some embodiments, conical sections located at the transition zones near the electrodes are included to provide funnel-like body-leg interface portions. The body-leg interface portions are shaped so as to advantageously control the temperature distribution along the internal surface of the discharge chamber wall so that it monotonically decreases resulting in a stable local cold spot location at the body-leg interface.

8 Claims, 12 Drawing Sheets

(56) References Cited

U.S. PATENT DOCUMENTS

| | | | | |
|---|---|---|---|---|
| 6,592,695 | B1 | 7/2003 | Polis et al. | |
| 6,592,804 | B1 | 7/2003 | Gauri | |
| 6,774,566 | B2 | 8/2004 | Honda et al. | |
| 6,781,311 | B2 | 8/2004 | Miyazawa | |
| 6,781,312 | B1 | 8/2004 | Sulcs et al. | |
| 6,857,926 | B1 | 2/2005 | Sulcs et al. | |
| 7,075,232 | B2 | 7/2006 | Maseki et al. | |
| 7,352,132 | B2 | 4/2008 | Ishigami et al. | |
| 7,414,366 | B2 | 8/2008 | Perez et al. | |
| 7,545,099 | B2 | 6/2009 | Rehn | |
| 7,667,406 | B2 | 2/2010 | Trypke | |
| 7,679,290 | B2 | 3/2010 | Utsubo et al. | |
| 7,839,066 | B2 | 11/2010 | Hrubowchak et al. | |
| 7,923,932 | B2 | 4/2011 | Lapatovich et al. | |
| 7,973,480 | B2 | 7/2011 | Marien et al. | |
| 7,977,884 | B2 | 7/2011 | Juengst et al. | |
| 8,004,195 | B2 | 8/2011 | Shido | |
| 8,350,477 | B2 | 1/2013 | Maehara et al. | |
| 8,390,196 | B2 | 3/2013 | Van Der Eyden | |
| 2002/0179859 | A1 | 12/2002 | Takeji et al. | |
| 2003/0080681 | A1 | 5/2003 | Kakisaka et al. | |
| 2004/0108814 | A1 | 6/2004 | Tsuda et al. | |
| 2004/0150336 | A1 | 8/2004 | Natchev et al. | |
| 2004/0168470 | A1 | 9/2004 | Scott et al. | |
| 2004/0256994 | A1* | 12/2004 | Venkataramani ..... | H01J 61/30 313/634 |
| 2005/0194908 | A1 | 9/2005 | Dakin et al. | |
| 2006/0119274 | A1 | 6/2006 | Dakin et al. | |
| 2007/0035250 | A1 | 2/2007 | Mucklejohn et al. | |
| 2007/0132396 | A1 | 6/2007 | Van Gennip et al. | |
| 2007/0138963 | A1 | 6/2007 | Russell et al. | |
| 2007/0216310 | A1* | 9/2007 | Shido ..... | H01J 61/827 313/634 |
| 2007/0267975 | A1 | 11/2007 | Ramaiah et al. | |
| 2008/0047665 | A1 | 2/2008 | Neil et al. | |
| 2008/0053611 | A1 | 3/2008 | Neil | |
| 2008/0054812 | A1 | 3/2008 | Brock et al. | |
| 2008/0106010 | A1 | 5/2008 | Gratson et al. | |
| 2008/0106203 | A1 | 5/2008 | Gratson et al. | |
| 2008/0122361 | A1 | 5/2008 | Lapatovich et al. | |
| 2008/0203921 | A1 | 8/2008 | Brock et al. | |
| 2008/0283522 | A1 | 11/2008 | Qin et al. | |
| 2009/0001887 | A1 | 1/2009 | Takeuchi et al. | |
| 2009/0066251 | A1 | 3/2009 | Wei et al. | |
| 2009/0072741 | A1 | 3/2009 | Kawasaki et al. | |
| 2009/0121633 | A1 | 5/2009 | Van Esveld et al. | |
| 2009/0130459 | A1 | 5/2009 | Kuenzler et al. | |
| 2009/0153053 | A1 | 6/2009 | Podevels | |
| 2009/0174327 | A1 | 7/2009 | Gibson et al. | |
| 2009/0224674 | A1 | 9/2009 | Selezneva et al. | |
| 2009/0316410 | A1 | 12/2009 | Takeda et al. | |
| 2010/0013389 | A1 | 1/2010 | Staut et al. | |
| 2010/0060183 | A1 | 3/2010 | Tamai | |
| 2010/0123393 | A1 | 5/2010 | Tu et al. | |
| 2010/0213860 | A1 | 8/2010 | Braun et al. | |
| 2011/0074286 | A1 | 3/2011 | Mueller et al. | |
| 2011/0127910 | A1 | 6/2011 | Arndt et al. | |
| 2011/0193466 | A1 | 8/2011 | Ohta et al. | |

FOREIGN PATENT DOCUMENTS

| | | | |
|---|---|---|---|
| EP | 1174904 | A1 | 1/2002 |
| EP | 1182681 | A1 | 2/2002 |
| EP | 1339091 | B1 | 11/2008 |
| EP | 1220295 | B1 | 9/2009 |
| EP | 1435642 | B1 | 9/2009 |
| EP | 1705680 | B1 | 9/2009 |
| EP | 1709667 | B1 | 1/2010 |
| EP | 1568066 | B1 | 2/2010 |
| EP | 1202323 | B1 | 9/2010 |
| EP | 1755147 | B1 | 4/2011 |
| EP | 2122654 | B1 | 4/2011 |
| EP | 2323156 | A3 | 6/2011 |
| JP | 2000030665 | A | 0/2000 |
| JP | 05303960 | A1 | 11/1993 |
| JP | 2001084957 | A | 3/2001 |
| JP | 2006048985 | A | 2/2006 |
| JP | 2006179489 | A | 7/2006 |
| JP | 2008027745 | A | 2/2008 |
| JP | 2010251252 | A | 11/2010 |
| WO | 2005062342 | A2 | 7/2005 |
| WO | 2008139186 | A1 | 11/2008 |
| WO | 2009077937 | A1 | 6/2009 |
| WO | 2009119100 | A1 | 10/2009 |
| WO | 2010076726 | A1 | 7/2010 |
| WO | 2011045696 | A2 | 4/2011 |
| WO | 2011092627 | A1 | 8/2011 |

* cited by examiner

OPTIMIZED HID ARC TUBE GEOMETRY

FIELD OF THE INVENTION

The present disclosure generally relates to optimizing High Intensity Discharge (HID) arc tube geometry to improve lamp color control and temperature distribution,

BACKGROUND

Ceramic Metal Halide ("CMH") lamps are special types of High intensity Discharge ("HID") lamps, and more specifically relate to Metal Halide, arc discharge lamps. These lamps are known to operate at high pressures and at high temperatures, and to have discharge vessels (frequently referred to as "arc tubes") made of a ceramic material. The arc tubes of CMH lamps include an ionizable fill of a noble gas such as Neon (Ne), Argon (Ar), Krypton (Kr) or Xenon (Xe) or a mixture of thereof, mercury or some of its alternatives the vapor of which serves as a buffer gas, and a mixture of metal halide salts such as, for example, NaI (sodium iodide), III (thallium iodide), $CaI_2$ (calcium iodide) and $REI_n$ (where $REI_n$ refers to rare-earth iodides). This mixture of metal halide salts (sometimes referred to as a "metal halide dose") is responsible for high luminous efficacy, excellent color quality and a white color of the lamps. Characteristic rare-earth iodides for CMH lamps may include one or more of $DyI_3$, $HoI_3$, $TmI_3$, $LaI_3$, $CeI_3$, $PrI_3$, and $NdI_3$.

Conventional HID lamps with ceramic arc tubes (such as High Pressure Sodium (HPS) and Ceramic Metal Halide (CMH) lamps) have arc tube designs of a "box-shaped" (cylindrical) geometry. This geometric limitation is essentially due to restrictions of early ceramic arc tube manufacturing technologies such as, for example, extrusion of the center body tube component and pressing of flat disk-shaped arc tube end parts (also referred to as "plugs"). As a consequence of the cylindrical geometry, conventional CMH lamps do not operate at a quasi-uniform temperature distribution across the entire center body portion of the arc tube. In particular, some regions of the discharge chamber of a conventional CMH arc tube may be cooler than others even during high-temperature steady-state operating conditions, and these relatively cooler regions form multiple local "cold spot" locations. Cylindrically shaped CMH arc tube designs exhibit cold corners which act as local cold spots, especially at the interface portion of the plug surface that closes off the cylindrical discharge chamber and the surface of the cylindrical center body tube. The vaporized metal halide salt within the discharge chambers of CMH lamps (such as sodium iodide vapor) may be present in a saturated vapor phase, wherein the vapor and liquid phases of the molten metal halide salts are in thermal equilibrium and are both present simultaneously. The equilibrium vapor pressure over the liquid phase is controlled by the temperature of the liquid phase which usually equals the temperature of the "coldest spot" on the internal surface of the wall of the discharge chamber, since this physical point and its surrounding area is the place where the vapor first condenses. However, once condensed, the flow of this liquid condensate is controlled by gravity so that it flows in a downward direction. If the condensed dose flows to a locally hotter location on the internal surface of the discharge chamber then it re-evaporates quickly, and such quick evaporation of the dose droplets results in spikes in temporal vapor dose density of the discharge plasma. Such spikes in vapor dose density in turn generate voltage spikes in lamp electrical characteristics, which also may result in spikes of light intensity and in correlated sudden color changes of emitted light from the lamp. Such spikes in light intensity and the associated sudden color changes are undesirable and are disturbing in high quality lighting environments such as, for example, in retail location lighting.

In designs where the two opposing electrodes of the CMH arc tube are moved further, away from each other, the light emitting electric arc discharge between them becomes a line emitter, and the surface of quasi-equal irradiation turns out to be an ellipsoid, which is still a member of the "spheroid-like" discharge chamber geometries. Such a concept has been used as the basis for shaping QMH discharge chambers in the past, and this same concept is currently being used to design state-of-the-art shaped CMH discharge chambers.

However, the heat radiation from the hot electrode tips reaching the internal surface of a CMH discharge chamber must also be taken into account. This additional irradiation from the electrodes on the arc tube wall can locally increase temperatures of some points on the end portions of the discharge chamber, which end portions are the interface areas where the central body portion of the arc tube meets the elongated tubular sealing portions (also referred to as "legs") of a CMH arc tube. Thus, when a CMH lamp is operating in a vertical orientation, localized heat radiation from the electrode can re-evaporate the liquid metal halide dose that is flowing down along the inside surface of the discharge chamber wall due to gravity. If the CMH arc tube is of a "ball-shape" design that consists of two hemispheres and which may also additionally include a cylindrical section at the arc tube center) vertical operation of the lamp is especially problematic because potential local overheating and re-evaporation of the liquid dose droplets may easily occur at the bottom body-leg interface section (the "body-leg transition portion") of such a CMH arc tube. This may occur because the hemispherical end portions of a ball-shaped arc tube design are not perfectly fitted to a heat radiation field of a line emitter, and cannot accommodate the additional localized heat flux from the electrodes. This phenomenon of electrical, light and color instabilities due to liquid dose movement and re-evaporation results in temporal color instability and increased color variability of a CMH lamp, which is often referred to as "dose instability".

A proposed solution to the problem of dose instability involves preventing the liquid metal halide dose from flowing down to locally hotter surfaces by providing a ring-like mechanical barrier or "nub" on the inside surface of the arc chamber to surround the electrode assembly (at the body-leg transition portion). If the vertical dimension (height) of such a nub is high enough to stop or block the vertical flow of the liquid dose from reaching the overheated point on the internal surface of the arc tube close to the electrode tips, dose instability can be significantly reduced or completely eliminated. However, such a nub creates sharp points on the ceramic arc tube body, and the nub may become the hottest part of the entire end portion of the ceramic arc tube body due to electrode heating. As a consequence, the nub and surrounding area may be exposed to the highest mechanical stresses and may be susceptible to forming cracks in the ceramic material. These cracks can then propagate to lower stress regions and may cause the arc tube to fully crack or even rupture during operation. In addition, some metal halide dose mixtures may operate to quickly erode the nub to such an extent that the nub cannot fulfill its dose stabilization function over the entire life of the lamp.

Another proposed solution for the problem of dose instability involves increasing the emissivity of the arc tube material at the locally overheated body-leg transition portion to promote more efficient cooling of the arc tube wall in this area. However, such a solution can alter or reduce the material strength of the wall, and especially at the most critical area where thermally induced stresses are high enough to crack the arc tube, which can again result in reduced lamp life. Furthermore, in practice controlling emissivity of the ceramic material locally is difficult, and excessive and uncontrolled cooling of the body-leg interface portion (which is also a cold spot location) of such CMH arc tubes may reduce equilibrium vapor pressures of metal halide salts too much, which can result in degraded lamp performance.

Yet another proposed solution for dose instability involves using an ellipsoidal-shaped transition zone between the arc tube center body portion and the body-leg interface portion. However, using an ellipsoidal-shaped transition zone limits geometrical flexibility of the shape both of the body-leg transition zone as well as that of the overall arc tube, and adds unnecessary complexity to the tooling of the ceramic arc tube forming process.

SUMMARY OF THE INVENTION

Presented are apparatus and methods for controlling the geometry of a High Intensity Discharge (HID) arc tube to provide improved lamp color control and temperature distribution. In some embodiments, conical sections located at the transition zones near the electrodes are included to provide funnel-like body-leg interface portions. The body-leg interface portions are shaped so as to advantageously control the temperature distribution along the internal surface of the discharge chamber wall so that it monotonically decreases resulting in a stable local cold spot location at the body-leg interface.

In another aspect, presented are apparatus and methods for providing a CMH lamp having a two-piece construction that includes a double-ended, slightly asymmetric discharge chamber with an axially asymmetric outside construction, wherein the slightly axially asymmetric discharge chamber provides a moderate axially asymmetric temperature distribution. In some implementations, the specific axially asymmetric construction geometry provides a moderate axially asymmetric temperature distribution, for example, to compensate for thermal asymmetry of an operating environment of a discharge vessel, like a single-ended outer jacket, an axially asymmetric reflector enclosure or vertical burning orientation

BRIEF DESCRIPTION OF THE DRAWINGS

Features and advantages of some embodiments, and the manner in which the same are accomplished, will become more readily apparent with reference to the following detailed description taken in conjunction with the accompanying drawings, which illustrate exemplary embodiments (not necessarily drawn to scale), wherein.

DETAILED DESCRIPTION

Figure 1:
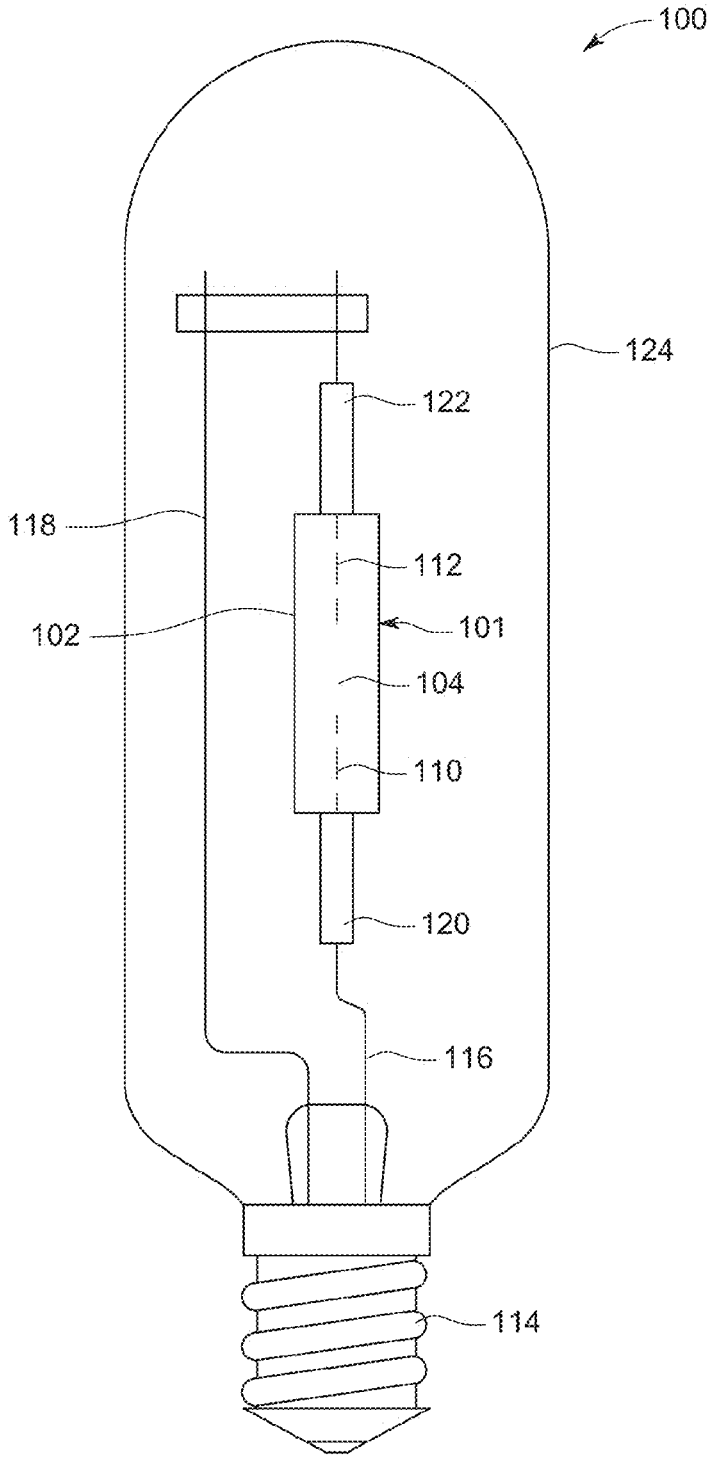
FIG. 1 (PRIOR ART)
FIG. 1 is a schematic diagram of a conventional high intensity discharge (HID) lamp.

FIG. 1 is a schematic diagram of a known embodiment of a high intensity discharge (HID) lamp, and more particularly a Ceramic Metal Halide (CMH) lamp 100. In general, a CMH lamp includes an arc tube 101 made of a translucent or transparent ceramic material, which arc tube is surrounded by a light transmitting outer envelope or outer bulb 124 made of for example, fused silica or hard glass. The outer bulb 124 may enclose a vacuum or may be filled with an inert gas such as nitrogen, and is provided with a lamp cap 114 at one end. The arc tube 101 includes ceramic walls 102 (having an internal surface and an external surface) that enclose a discharge chamber 104. The discharge chamber 104 is typically filled with a liquid dose that operates under standard operating conditions at high temperature of the lamp. The arc tube 100 also includes two electrodes 110 and 112 that are arranged opposite to each other and extend into the discharge chamber 104. The electrode 110 is connected to a first electric contact forming part of the lamp cap 114 via a current lead-through conductor 116. The electrode 112 is connected to a second electric contact forming part of the lamp cap 114 via a second current lead-through conductor 118, which may be called a "frame". In some embodiments, the outer bulb 124 may have two caps, with a first cap on a first end and a second cap on a second end, and with a first electrode connected to the first cap and the second electrode connected to the second cap. In the embodiment as shown in FIG. 1 the arc tube 101 of the CMH lamp 100 also includes protruding end plugs 120 and 122 which may also be called "legs" that are arranged to enclose at least part of the electrodes 110 and 112, respectively. During operation of the CMH lamp 100, an electric arc discharge extends between the tips of the electrodes 110 and 112 to provide the useful visible electromagnetic radiation (light) of the tamp.

It should be understood that the ceramic walls 102 of the arc tube 101 may be composed of a vacuum-tight and halide-resistant ceramic material, for example, a metal oxide such as sapphire or densely sintered polycrystalline aluminum oxide ($Al_2O_3$), yttrium aluminum garnet (YAG), or a metal nitride, for example, aluminum nitride (AlN). Other halide-resistant ceramic materials could also be utilized. Such ceramic materials are suitable for forming a translucent or transparent arc tube wall.

Figure 2:
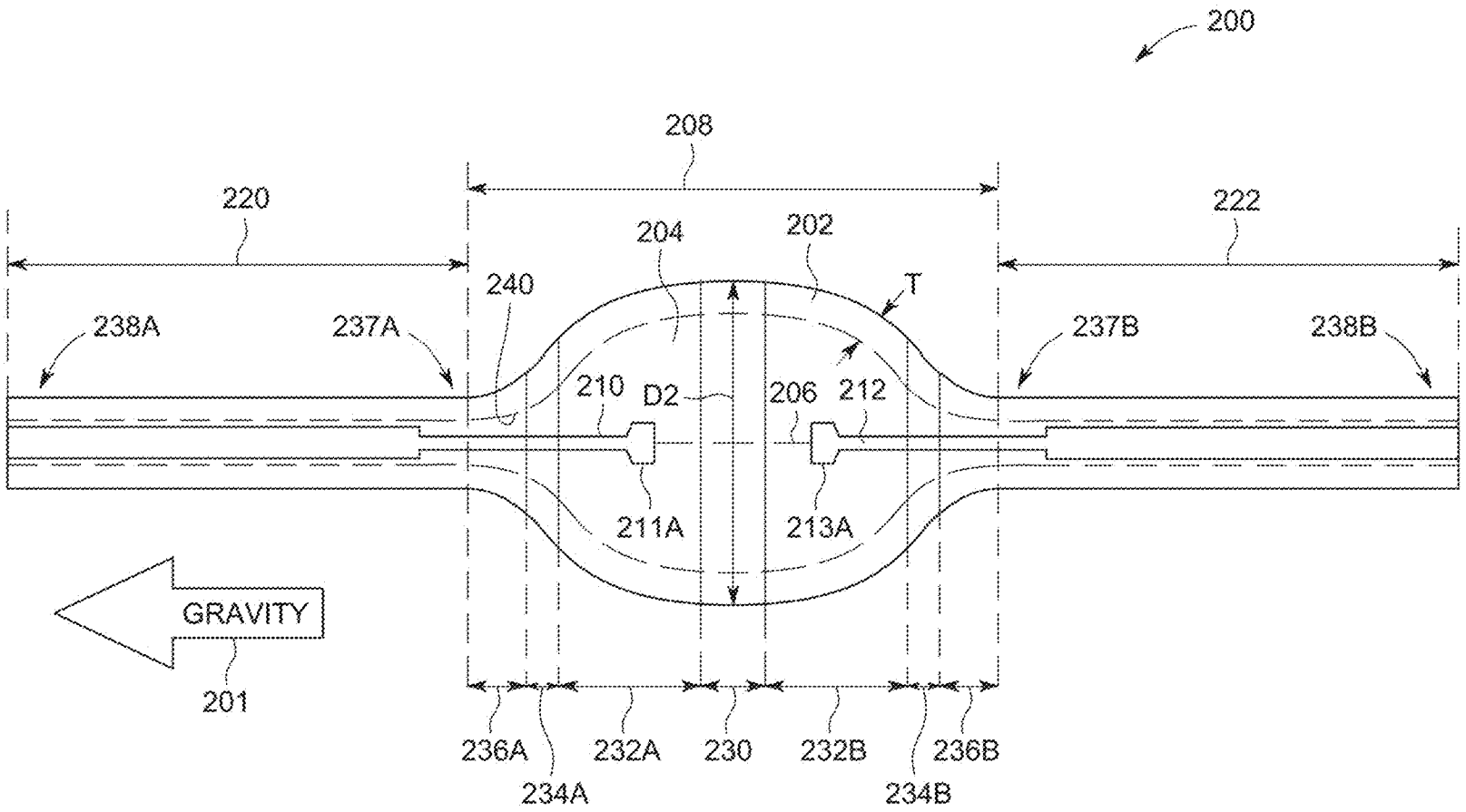
FIG. 2 is a cutaway view of an arc tube according to an embodiment of the invention in a vertical orientation where the direction of gravity is indicated by an arrow.

FIG. 2 is a horizontal, cutaway view of an arc tube 200 according to an embodiment of the invention. An arrow 201 shows the direction of gravity when the arc tube lamp is operating in a vertical orientation. The arc tube 200 may have a ceramic arc tube wall 202 construction to define a discharge chamber 204. The arc tube may be incorporated into a high-intensity discharge (HID) lamp, for example, into a Ceramic Metal Halide (CMH) lamp. Accordingly, the arc tube 200 may replace the arc tube 101 of the CMH lamp 100 of FIG. 1.

The discharge chamber 204 is typically filled with a noble gas such as neon (Ne), argon (Ar), krypton (Kr) or xenon (Xe) or a mixture of thereof), mercury (or some of its alternatives, the vapor of which serves as a buffer gas), and a mixture of metal halide salts, for example, NaI (sodium iodide), TlI (thallium iodide), $CaI_2$ (calcium iodide) and $REI_n$ (where $REI_n$ refers to rare-earth iodides). This mixture of metal halide salts (sometimes referred to as a "metal halide dose") is responsible for high luminous efficacy, excellent color quality and a white color of the lamps.

In accordance with novel embodiments disclosed herein, it has been recognized that the localization and stabilization of the cold spot location of a CMH arc tube close to its body-leg transition portion is extremely important in order to provide good temporal color stability and low color variability of a CMH lamp. Ideally, the cold spot location of a CMH arc tube must be approximately at the body-leg interface portion. In particular, the cold spot location should be outside the discharge chamber but at the hottest point inside the arc tube leg in order to prevent dose instability and to achieve the best potential performance of the specific CMH arc tube design. However, if the cold spot location cannot be located outside the discharge chamber, then it should be located at a local temperature and gravity minimum inside the discharge chamber so that the liquid dose cannot flow down to locally hotter areas below this local minimum point when the lamp is in a substantially vertical orientation.

Thus, in accordance with embodiments described herein, the geometry of the CMH arc tube is controlled during manufacture to include additional conical sections, (shown as conical sections 234A and 234B in FIG. 2), each of which are located at the transition zone near the electrode. For example, the conical section 234A is located between a central part of the discharge chamber 232A and the body-leg interface portion 236A. In addition, care is taken to ensure that a funnel-like body-leg interface zone (discussed in more detail below) is properly shaped so as to advantageously control the temperature distribution along the internal surface of the discharge chamber wall so that it monotonically decreases to thus provide a stable local cold spot location at the body-leg interface portion.

Referring again to FIG. 2, the arc tube 200 includes a hypothetical major axis illustrated as dotted line 206 and a largest diameter D2. The ceramic arc tube wall 202 may have a thickness "T" and encloses a discharge chamber 204 that contains an ionizable filling, such as a metal-halide dose. Two facing electrodes 210 and 212 are located within the discharge chamber 204, and each has an electrode tip 211A and 213A. The electrode tip 211A is positioned opposite the electrode tip 213A as shown to have a predetermined distance between them in the arc chamber, which can be referred to as an "arc gap". The two electrode tips 211A and 213A may be made of tungsten or tungsten alloy, whereas the central portion of the electrodes may be made of molybdenum.

Referring to FIG. 1, in an implementation the lead-through conductors 116 and 118 (not shown in FIG. 2.) are connected to each electrode 210 and 212. In FIG. 2, the electrodes 210 and 212 leave the discharge chamber though seal portions (not shown) that are located at remote ends 238A and 238B of the arc tube 200. The seal portions seal the arc tube in a gastight manner, wherein a melting-ceramic joint or seal glass may be utilized to form the gastight seal. In some arc tube embodiments, the two opposing openings of the central part of discharge chamber 204 may be closed by end plugs (not shown) that also each encloses the seal portions, and the arc tube 200 may substantially consist of only the center body portion 208 (i.e., the arc tube does not include the two elongated end structures 220 and 222, sometimes referred to as "le s"). Thus, in some embodiments, the arc tube 200 may include only the generally spherical or generally elongated spherical center body portion 208. Accordingly, it should be understood that an arc tube structure in accordance with the invention is not limited to the arc tube 200 embodiment that is shown in FIG. 2, but is instead described herein in general terms and then in aspects that include ranges of dimensions of the various shaped portions thereof.

Referring again to FIG. 2, during operation of the CMH lamp the metal-halide dose within the discharge chamber 204 is in a saturated vapor phase, wherein vapor and liquid phases of the molten metal halide salts are in thermal equilibrium, and both phases are present at the same time. The equilibrium vapor pressure is controlled by the temperature of the liquid phase temperature, which typically equals the temperature of the "coldest spot" on the ceramic arc tube wall 202, as this is the point where the vapor first condensates. However, once condensed, the liquid condensate of metal halide mixture (also called as the "liquid dose") will flow downwards under the influence of gravity. If the condensed dose flows to a locally hotter location on the internal surface of the discharge chamber 204 then it wilt re-evaporate quickly.

Ideally, in vertical operation of CMH lamps, the lowest vertical point of the discharge chamber 204 should be the coldest temperature point (the "cold spot") in order to prevent voltage spikes and undesirable changes in light intensity and color. If the coldest spot is not located inside and at the lowest vertical point of the discharge chamber 204, then the next best location of the cold spot is at a local vertical temperature and gravity minimum so that the liquid dose cannot flow down to locally hotter areas situated below such a local gravity minimum.

Referring again to FIG. 2, the arc tube 200 includes a luminous center portion or arc tube body portion 208, a first (bottom) leg 220, and second (top) leg 222. The arc tube body 208 includes an optional cylindrical portion 230, first and second curved portions 232A and 232B, first and second conical portions 234A and 234B, and first and second body-leg transition portions 236A and 236B. The first and second curved portions 232A and 232B are constructed or formed by a convex arc section rotated around the major axis 206 (part of a spindle torus). The first and second conical portions 234A and 23413 bridge the first and second curved portions 232A and 23213 to the first and second body-leg transition portions 236A and 236B, which enclose the two electrodes 210 and 212. The first and second body-leg transition portions 236A and 236B can be visualized or are formed as a concave arc section rotated around the major axis 206 to provide a "funnel-like" shape of the body-leg transition portions. The radius of curvature of the first and second curved portions 232A and 232B and the first and second body-leg transition portions 236A and 236B, as well as the cone angle of the first and second conical portions 234A and 234B are chosen and/or formed so that the temperature of the arc tube wall 202 monotonically decreases towards the ends of the arc tube 200, even with electrode heating taken into account. Thus, when the arc tube 200 is in a vertical orientation, such that gravity acts in the direction of the arrow 201 (wherein the first leg 220 is closest to the floor), the temperature of the arc tube wall 202 close to the bottom electrode 210 will be below the temperature of any point of the wall that is higher up (further away from the floor or ground). Thus, a localized cold spot is created at the area of the first body-leg transition portion 236A or its surrounding area that is just outside the discharge chamber 204 and inside the first leg 220.

In the embodiment illustrated by FIG. 2, the thickness "T" of the arc tube wall 202 is substantially uniform over the entire arc tube assembly 200. However, in some implementations, an additional and/or optional feature may include providing a wall thickness in the location of the first and second body-leg transition points 237A and 237B that is thicker than the wall thickness formed at the first and second leg outer ends 238A and 238B, such that the first leg 220 and second leg 222 are tapered. In particular, a conical shaping of the first and second legs 220 and 222 outer geometry may be provided to increase mechanical strength of the first and second body-leg transition points 237A and 237B, to create a smooth transition geometry between the arc tube body 208 and the first and second legs 220 and 222, and to support localization of the cold spot inside the arc chamber close to the first transition point 237A or dose to the second transition point 237B (depending on the orientation of the arc tube 200). Additionally, such a conical leg structure advantageously supports manufacturing of CMH arc tubes, for example, in the case of using injection molding technology to form the CMH arc tubes.

The arc tube 200 may be used to replace conventional CMH arc tubes, and is optimized to provide a stable and well-defined "cold spot" location of the discharge chamber 204. Such a stable cold spot location provides a stable position for the liquid dose (the metal halide salt pool) that is situated on the inside surface 240 of the discharge chamber wall 202. In other words, the CMH arc tube is designed such that no liquid dose movement occurs during steady-state lamp operation (when the tamp is operated in a vertical position such that gravity acts in the direction of arrow 201).

Figure 3B:
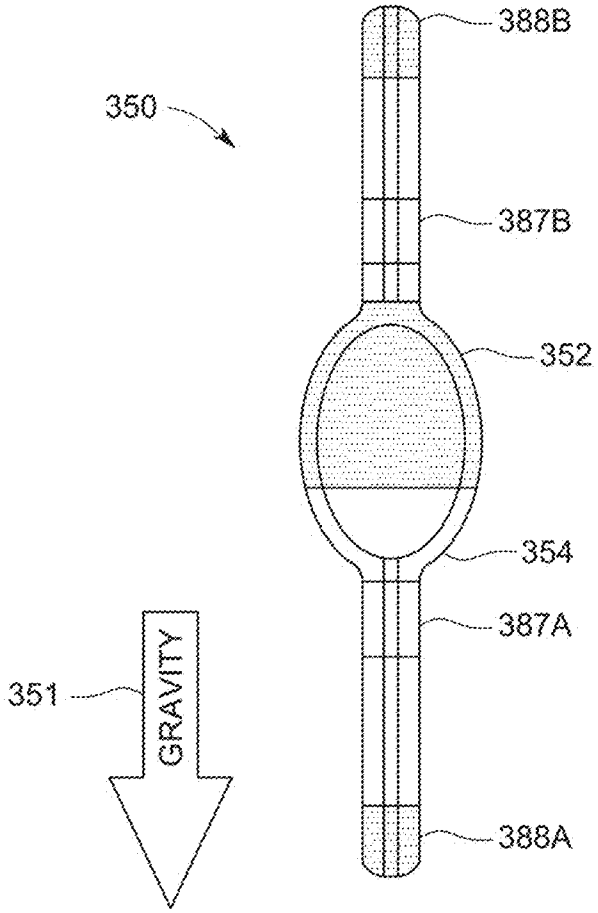
FIG. 3B is temperature schematic diagram depicting steady-state analysis simulation results of the temperatures occurring within the arc tube component of FIG. 2 when operating in a vertical orientation in accordance with embodiments of the invention.
Figure 3A:
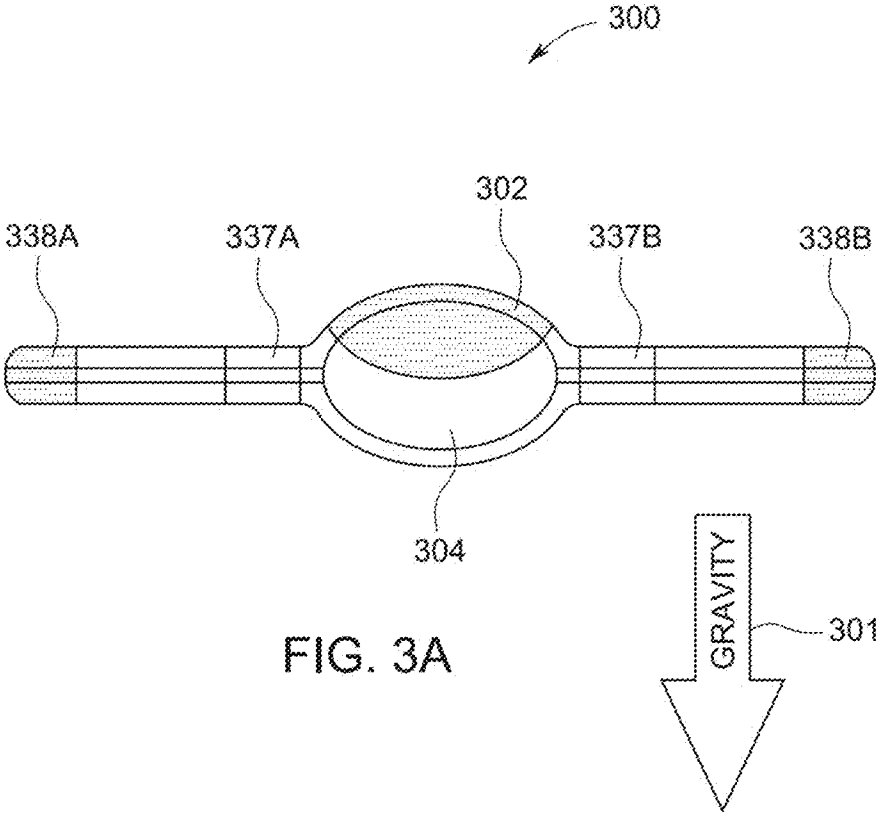
FIG. 3A is temperature schematic diagram depicting steady-state analysis simulation results of the temperatures occurring within the arc tube component of FIG. 2 when operating in a horizontal orientation in accordance with embodiments of the invention.

FIG. 3A is temperature schematic diagram 300 depicting a horizontal orientation (wherein gravity acts in the direction of the arrow 301), steady-state analysis simulation of the temperatures occurring within the arc tube component of FIG. 2 in accordance with some embodiments. In particular, the diagram 300 graphically depicts estimated temperatures that may occur within the arc tube wall 202 during 39 watt operation of the CMH lamp. In such a situation, the electrode tips of the electrodes (not shown) may reach temperatures of about 3150 degrees Kelvin (3150 K) during operation. Thus, as graphically depicted in FIG. 3A, a high temperature of about 1400 K occurs in the upper wall portion 302 of the arc tube above the arc discharge which is bowing upwards due to buoyancy forces that are induced by gas convection within the discharge chamber, whereas the temperature in the bottom wall portion of the discharge chamber 304 is lower at about 1300 K. The temperature drops to about 1250 K at the body-leg transition portions 337A and 337*b*, and is lowest at about 750 K at the extreme ends 338A and 338B of the leg portions. Thus, the metal-halide dose condensate within the discharge chamber will flow under the influence of gravity in a downward direction (as shown by the arrow 301) towards the bottom portion of the discharge chamber 304 of the horizontal CMH arc tube 300. Since the condensed dose is flowing to this cooler location representing a stable local gravity minimum (stable mechanical equilibrium) within the discharge chamber, it will evaporate evenly and will not cause spikes in the vapor dose density. Thus, when the CMH arc tube 300 is operating in a horizontal orientation voltage spikes and undesirable changes in light intensity and color will not occur.

FIG. 3B is temperature schematic diagram 350 depicting a vertical orientation (wherein gravity acts in the direction of the arrow 351) steady-state analysis simulation results of the temperatures occurring within the arc tube component of FIG. 2 in accordance with some embodiments. In particular, the diagram 350 graphically depicts the temperatures that may occur within the arc tube wall 202 in a vertical orientation during 35 watt operation of the CMH tamp. In such a situation, the electrode tip of the upper electrode (not shown) may reach temperatures of about 3180 degrees Kelvin (3180 K) during operation. Thus, as graphically depicted in FIG. 3B, a high temperature of about 1350 K occurs in the upper portion 352 within the wall of the discharge chamber, whereas the temperature in the lower wall portion of the discharge chamber 354, which includes the bottom body-leg transition portion of the arc tube, is lower at about 1220 K. The temperature drops to the value of about 1150 K after the body-leg transition portion 387A in the lower leg, and is lowest at about 740 K at the extreme end 388A of the lower leg. Thus, the metal-halide dose condensate within the discharge chamber of the arc tube 350 will flow under the influence of gravity in a downward direction (the direction of the arrow 351) towards the lower portion 354 of central body part of the arc tube 350. As mentioned above, the radius of curvature of the body-leg transition portion 354 is properly chosen and/or formed so that the wall temperature monotonically decreases towards the end of the arc tube closest to the ground even with electrode heating taken into account. Thus, the lower portion of central body portion 354 represents a local temperature minimum for the condensed dose within the discharge chamber, that is, it provides a localized cold spot for the condensed dose so that voltage spikes and undesirable changes in light intensity and color will not occur.

Figure 4:
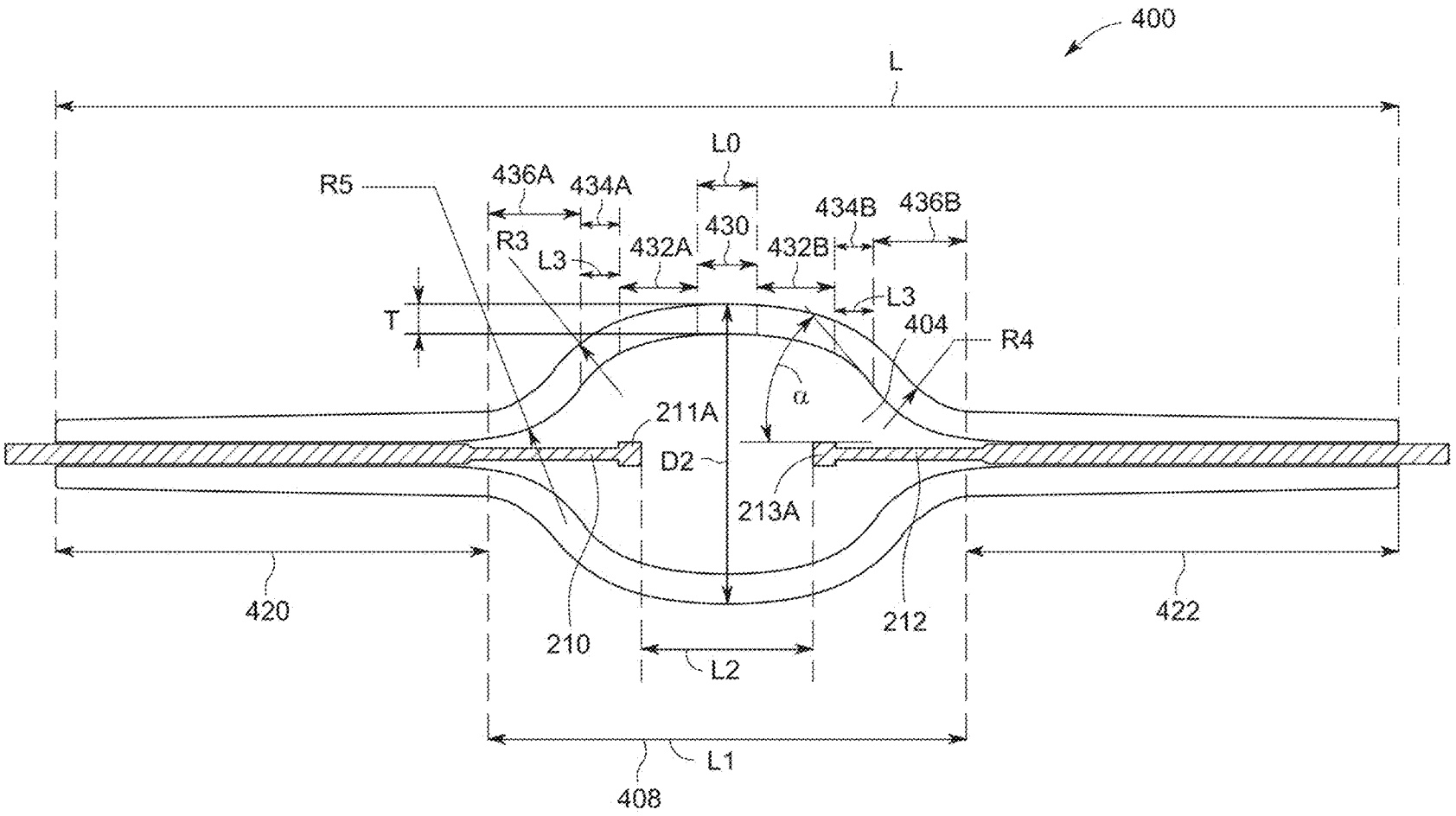
FIG. 4 illustrates an example of an CMH arc tube according to an embodiment of the invention.

FIG. 4 illustrates a 35 Watt CMH arc tube 400 according to an embodiment. The arc tube 400 includes a discharge chamber 404 and the arc tube has a thickness "T" of about 0.6 millimeters (0.6 mm), but T can be in the range of about 0.4 mm to about 2.0 mm. In some embodiments, the luminous center body portion 408 has a constant wall thickness, and the leg portions 420 and 422 may also have a constant wall thickness. However, as mentioned above, in some embodiments the wall thickness in these leg portions may be different such that the legs portions 420 and 422 are tapered. In the embodiment shown, the total length L of the arc tube is about 29.7 mm, with the length L1 of the central body portion 408 is about 10.1 mm. The length L0 of the optional cylindrical portion 430 of the central body portion is about 1.2 mm, and the length L2 distance between the electrode tips 211A and 213A (the "arc gap") is about 4.5 mm. The length L3 of the conical portions 434A and 434B is about 0.7 mm, but in some embodiments L3 is greater than the wall thickness T divided by 2, and less than the largest diameter D2 divided by 2. As shown, the cone half angle $\alpha$ is about forty-five degrees (45°), but in some embodiments may be in the range of from about forty degrees (40°) to about fifty-five degrees (55°). In some embodiments, the outer surface of the leg portions 420 and 422 may have a cone half angle in the range of about zero degrees (0°) to about two degrees (2°). In the embodiment as shown in FIG. 4, the largest diameter D2 of the central body portion 408 is about 6.2 mm. The internal radius of curvature R5 of about 2.3 mm defines the internal radius of curvature of the body-leg transition portions 436A and 436B, but in some embodiments R5 may be between 0 and R3, whereas the radius R3 of about 3.7 mm defines the radius of curvature of the flanking curved portions 432A and 432B that are located between the optional cylindrical center portion 430 and the flanking conical portions 434A and 434B. The radius R4 of about 2 min defines the external radius of curvature of the body-leg transition portion.

The optimized arc tube geometry according to embodiments is beneficial for all (ceramic) metal halide lamps where at least some of the metal halides have a condensed liquid phase (i.e., the metal halides are present in a saturated vapor form). The embodiments are particularly beneficial if the dose composition is such that it wets the ceramic surface. In this case, the condensed liquid dose sticks to the ceramic surface and may form large droplets before flowing downwards in the direction of gravity. In some embodiments, the metal halide dose may be composed of NaI, $LaI_3$, TlI and $CaI_2$ wherein these iodides are present in the approximate ranges of: 20-50 wt %, 110-30 wt %, 3-110 wt % and 25-60 wt %, respectively.

As explained above, a beneficial consequence of dose positional stability within a CMH arc tube in accordance with some embodiments is that temporal variations of lamp color, luminous flux, and electrical parameters all become more stable and thus are improved when compared to conventional CMH arc tube designs. In particular, temporal color control of (shaped) CMH arc tubes is achieved by constructing the discharge chamber 204 of the arc tube 200 shown in FIG. 2 (and the discharge chamber 404 of the arc tube 400 of FIG. 4) such that the temperature of the ceramic wall decreases monotonically from the axial center point of the discharge chamber. In particular, if the arc tube 200 (and/or arc tube 400) is operating in a vertical orientation then the temperature of the ceramic wall decreases monotonically towards the bottom leg (closest to the floor) to prevent dose condensation other than at the pre-defined cold spot located at the area of lowest point of the discharge chamber 204, or at the location surrounding the top portion of the bottom leg, that is, substantially at the body-leg transition portion 237A of the arc tube 200. In other words, CMH arc tube design in accordance with embodiments described herein results in more consistent color, lumens and electrical parameter performance, and provides stable and flicker-free lamp operation.

In addition to providing improved control of CMH lamp characteristics, the optimized geometry of the CMH arc tubes disclosed above reduces thermally induced stresses that can develop inside the ceramic walls of the arc tube 200 (or arc tube 400), which improves the long-term reliability of the lamp. Such structure also results in a more robust HID lamp having a reduced failure rate, and thus results in a reduced number of customer complaints. These improved features of a CMH arc tube design are achieved by optimizing the arc tube geometry, including the shape of the discharge chamber, the shape of the body-leg transition portion, and by controlling the arc tube wall thickness distribution all along the arc tube.

Furthermore, the structure of the arc tubes described above have a simple geometry that is less costly to produce than conventional CMH arc tube designs that include ellipsoidal or quasi-ellipsoidal sections. Accordingly, these arc tubes provide improved HID lamp product performance that is achieved at reduced manufacturing scrap rates and reduced cost.

The nominal power range of CMH lamps having an arc tube geometry as described above can vary depending on the application. For example, CMH lamps for retail lighting applications may have a nominal operating power range of from about twenty watts (20 W) to about one-hundred and fifty watts (150 W), whereas CMH lamps for use in outdoor/high bay lighting may have a nominal operating power range of from about 250 W to about 800 W, and CMH lamps for use in sports lighting may have a nominal operating power range from about 1 kW to about 2 kW. Thus, the thickness characteristics of such lamps will also vary.

Further embodiments, which are described below, generally relate to HID lamps and more particularly to providing a CMH lamp with a double-ended discharge chamber having a specific axially asymmetric construction geometry that provides a moderate axially asymmetric temperature distribution. In some implementations, the specific axially asymmetric construction geometry can be designed to provide a moderate axially asymmetric temperature distribution, for example, to compensate for thermal asymmetry of an operating environment of a discharge vessel, like a single-ended outer jacket, an axially asymmetric reflector enclosure or vertical burning orientation.

Figure 5A:
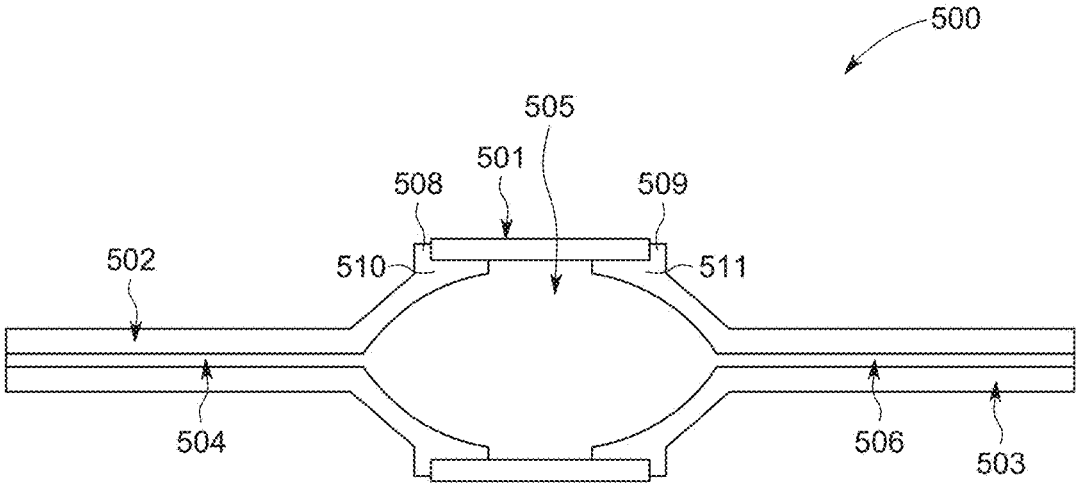
FIG. 5A (PRIOR ART)
FIG. 5A is a schematic, cutaway diagram of an embodiment of an assembled conventional three-piece, shaped HID CMH discharge vessel body embedding an axially symmetric discharge chamber in a horizontal orientation before sintering.
Figure 5B:
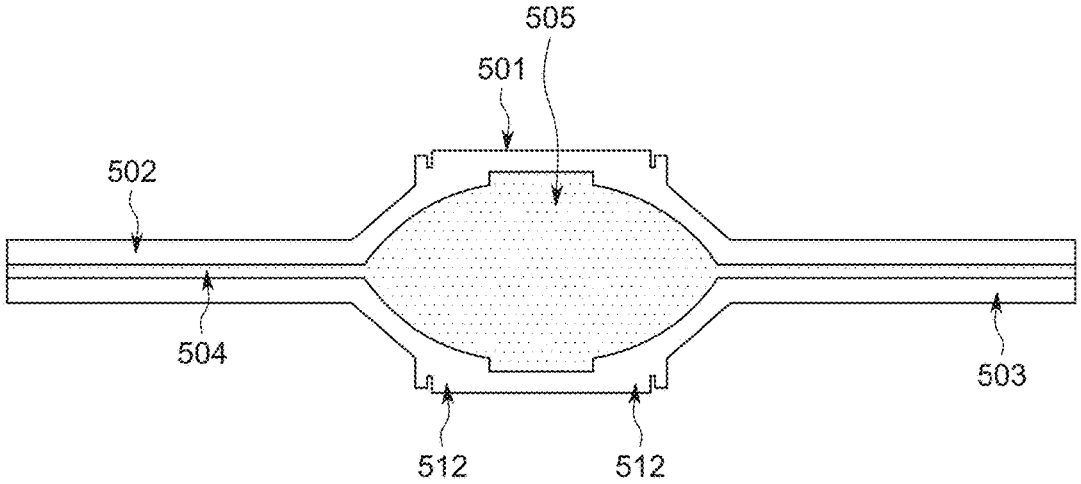
FIG. 5B (PRIOR ART)
FIG. 5B is a schematic cutaway diagram of the conventional three-piece, shaped HID CMH discharge vessel body of FIG. 5A after sintering.

FIG. 5A is a schematic, cutaway diagram of an embodiment of an assembled conventional three-piece, shaped HID CMH discharge vessel body 500 embedding an axially symmetric discharge chamber in a horizontal orientation. The CAE discharge vessel body 500 includes a ceramic cylindrical discharge chamber tube 501 configured for connection between a first combined leg-plug piece 502 and a second combined leg-plug piece 503 to form an internally quasi-ellipsoidally shaped and substantially axially symmetric discharge chamber 505. The first combined leg-plug piece 502 includes a leg portion with a leg bore 504 to accommodate the first electrode, and a quasi-conical endplug portion which portions are injection molded as one single piece. Similarly, the second combined leg-plug piece 503 includes a leg portion with a leg bore 506 to accommodate the second electrode and a quasi-conical endplug portion, which portions are again injection molded as one single piece. The first combined leg-plug piece 502 and the second combined leg-plug piece 503 are considered as "male" ceramic pieces because they include circular discs or stops 508, 509 and cylindrical ledges or shelves 510, 511, wherein the cylindrical ledges 510, 511 are inserted into the cylindrical discharge chamber tube 501 (which is considered to be a "female" ceramic piece) up to the stops or discs 508, 509 when assembling the CMH discharge vessel body 500. As shown, the assembled discharge vessel body 500 has an embedded discharge chamber of a substantially axially symmetric and internally quasi-ellipsoidal geometry FIG. 5B is a schematic cutaway diagram of the conventional three-piece, shaped HID CMH discharge vessel body 500 of FIG. 5A after sintering. As explained above, the CMH discharge vessel body 500 includes a ceramic cylindrical discharge chamber tube 501 that is now co-sintered with a first combined leg-plug piece 502 and a second combined leg-plug piece 503 to forma vacuum-tight discharge chamber 505. Co-sintered ceramic joints 512 have been formed by the sintering process to make the discharge vessel body 500 a single-piece component. After being filled with the dose and sealed, the single-piece discharge vessel body 500 provides a discharge vessel for a CMH lamp which has a discharge chamber of a substantially axially symmetric geometry, and consequently, a substantially axially symmetric temperature distribution under "neutral" operating conditions of the CMH discharge vessel (for example, in horizontal operation and without an outer bulb surrounding the discharge vessel).

Figure 6A:
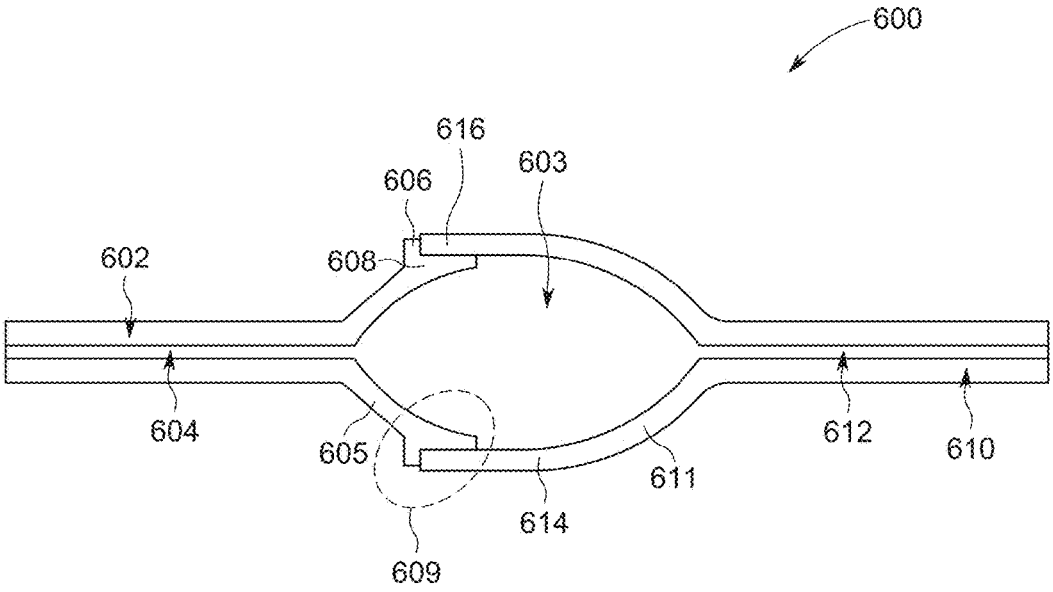
FIG. 6A is a schematic, cutaway diagram of an embodiment of an assembled two-piece, shaped HID CMH discharge vessel body embedding an axially asymmetric discharge chamber in a horizontal orientation before sintering in accordance with an embodiment of the invention.

FIG. 6A is a schematic, cutaway diagram of an embodiment of an assembled two-piece, shaped and axially asymmetric HID CMH discharge vessel body 600 embedding an axially asymmetric discharge chamber 603 in a horizontal orientation before sintering in accordance with novel aspects described herein. The CMH discharge vessel body 600 includes a first combined leg-plug piece 602 that includes a leg portion with a leg bore 604 to accommodate the first electrode, and that includes a quasi-conical endplug portion 605 which portions are injection molded as one single piece. The first combined leg-plug piece 602 is similar to the first combined leg-plug piece 502 of FIG. 5A, as it is also considered as a "male" ceramic component of a conical endplug portion because it similarly includes a circular disc or stop 606 and a cylindrical ledge or shelf portion 608. The second combined leg-plug-centerbody piece 610 also includes a leg portion with a leg bore 612 to accommodate the second electrode, a quasi-ellipsoidal endplug portion 611, and additionally, a quasi-tubular centerbody portion 614, which portions are again injected molded as one single piece. The quasi-tubular centerbody portion 614 includes a circular distal edge portion 616 which is shaped and/or sized to fit onto or connect to the cylindrical ledge portion 608 up to the stop 606 (as shown). Thus, the first combined leg-plug piece 602 and the second combined leg-plug-centerbody piece 610, when fitted or assembled together as shown, form a two-piece, shaped HID CMH discharge vessel wherein the discharge chamber 603 defined therebetween is of an axially asymmetric geometry. In particular, the discharge chamber 603 has a quasi-ellipsoidal and substantially axially symmetric inside surface geometry but has an axially asymmetric outside surface geometry.

Figure 6B:
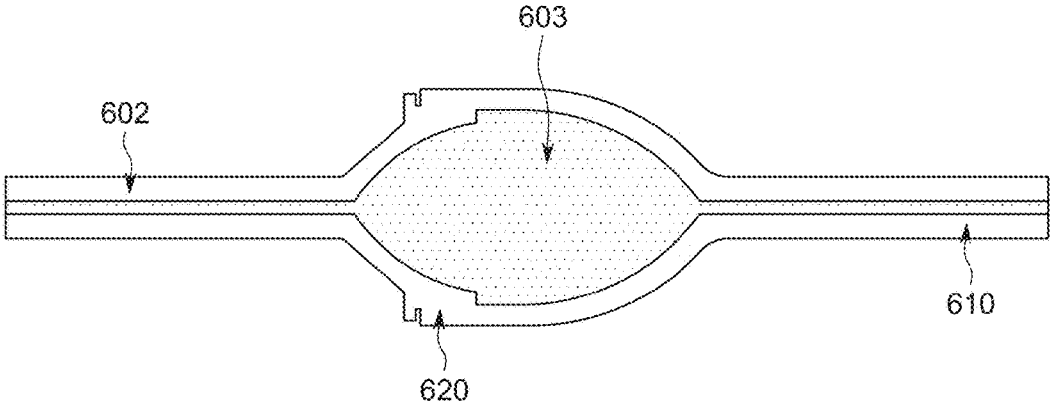
FIG. 6B is a schematic cutaway diagram of the two-piece, shaped HID CMH discharge vessel body of FIG. 6A after sintering in accordance with an embodiment of the invention.

FIG. 6B is a schematic cutaway diagram of the two-piece, shaped and axially asymmetric HID CMH discharge vessel body 600 of FIG. 6A after sintering. The CMH discharge vessel body 600 includes a "male" first combined leg-plug piece 602 that is now co-sintered with the second combined leg-plug-centerbody piece 610 to form a vacuum-tight discharge chamber 603. After sintering, the co-sintered ceramic joint 620, if done correctly and/or done well, cannot be discerned, since structural and compositional differences between the two originally separated ceramic components are smoothed away by the sintering process, and there is no sign of a former joint line remaining After being filled with the dose and sealed, the single-piece discharge vessel body 600 thus formed provides a discharge vessel for a CMH lamp. As a result of the additional surface area and excess ceramic volume in the co-sintered area depicted as a dotted line circle 609 in FIG. 6A, as well as to the related minor asymmetry in the quasi-ellipsoidal internal geometry of the discharge chamber 603, the chamber wall portion at the quasi-conical leg-plug "male" side 602 of the discharge chamber 603 operates slightly colder than at the shaped leg-plug-centerbody "female" side 610 (when under "neutral" operating conditions, for example, in horizontal operation and without an outer bulb surrounding the discharge vessel). Consequently, the axial temperature distribution of the HID CMH discharge chamber 603 of a specific axially asymmetric geometry described herein also becomes moderately axially asymmetric.

Figure 7:
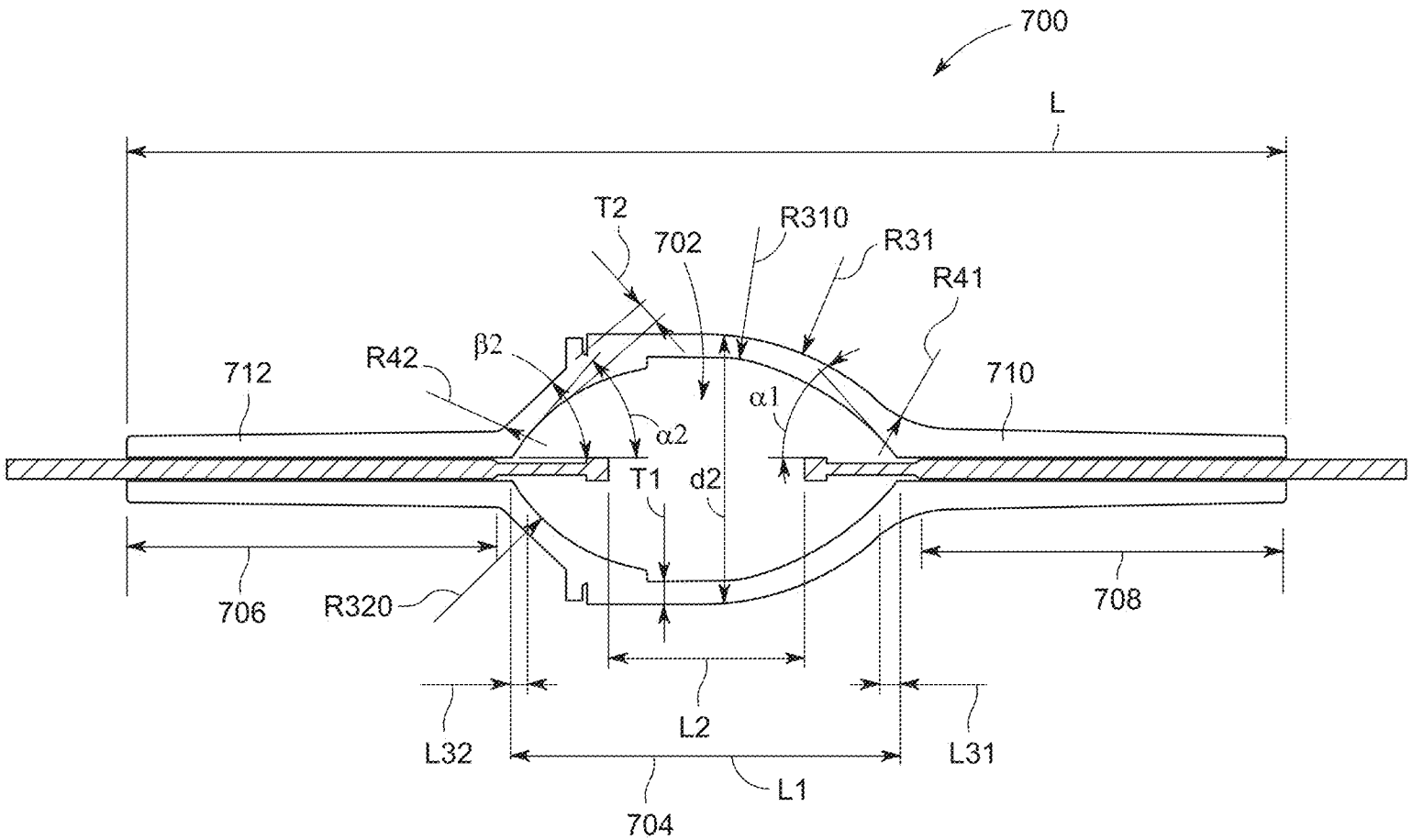
FIG. 7 depicts a detailed construction geometry of a 35 W CMH discharge vessel embedding an axially asymmetric discharge chamber in accordance with embodiments of the present invention.

FIG. 7 depicts a detailed construction geometry for a 35 Watt CMH discharge vessel 700 that includes an embedded axially asymmetric discharge chamber 702 in accordance with some embodiments. It should be understood that the particular construction geometry illustrated by FIG. 7 and described below is for illustrative purposes only and does not limit the scope of the novel aspects described herein in any manner.

In accordance with embodiments described herein, the CMH discharge chamber 702 shown in FIG. 7 is formed to have an axially asymmetric temperature distribution. The discharge vessel can itself be manufactured to contain legs or may be a legless design, or a combination of the two. The axial thermal asymmetry of the discharge chamber is created by the axially asymmetric design geometry of the chamber itself, and any additional thermal effect that may be caused by the leg portions of the discharge vessel are not taken into consideration, since both leg portions are assumed to be of substantially identical geometry. An axial thermal asymmetry can be desirable because a CMH discharge chamber with such characteristics can be used as a thermal compensation tool under some circumstances, such as in some environmental cases and/or in some orientation cases. For example, referring to FIG. 6A, a portion of the discharge chamber 603 adjacent the "male" first combined leg-plug piece 602 exhibits a slight lossy thermal characteristic such that the temperature in that region is less than the temperature adjacent to the "female" combined leg-plug-centerbody piece 610, which may be desirable under certain operating conditions.

An inherent axially asymmetric temperature distribution in a CMH discharge chamber can, for example, be realized by creating a substantially "isothermal" inside chamber geometry, and by creating a "non-isothermal." outside chamber geometry. In some embodiments described herein, as explained above, the ceramic discharge vessel embedding the axially asymmetric discharge chamber is made of two pieces or components joined outside the axial centerline of its chamber (wherein the co-sintered joint area is closer to one end of the chamber, nearer the "male" leg portion), which construction retains high reliability of the joint, in some embodiments, a conventional interference fit based ceramic co-sintering technique is used. The substantially conical "male" ceramic component of the discharge chamber has a smaller diameter and shorter length than the second, "female" shaped component (which is of a larger diameter and longer length). In some embodiments, the "male" component only constitutes an end portion, while the "female" component includes both the center portion and an opposite end portion that forms the discharge chamber. After co-sintering, the inside surface geometry of the discharge chamber is of a quasi-ellipsoidal, and axially and rotationally symmetric ("isothermal") shape. However, the outside surface area and the ceramic volume at the "mate" component end is larger than that of the "female" component, which is due to the features required for co-sintering (the circular disc and the cylindrical ledge portions, explained above) which results in a double configuration at the sintering joint. As a result, during operation under "neutral" operating conditions (for example, in horizontal operation and without an outer bulb surrounding the discharge vessel), the "male" component end becomes slightly colder than that of the "female" component end, and the discharge chamber becomes thermally axially asymmetric (axially "non-isothermal"). This axial thermal asymmetry can be adjusted or modified by optionally shifting the arc gap along the axial direction within the discharge chamber by, for example, manipulating the positions of the electrode tips.

Thus, referring again to the 35 Watt CMH arc tube 700 shown in FIG. 7, a discharge chamber 702 is defined by an arc tube with a ceramic wall thickness "T" in the range of about 0.4 mm to about 2.0 mm. In some embodiments, the luminous center body portion 704 has a generally constant wall thickness, and the leg portions 706 and 708 may also have a generally constant wall thickness or may be tapered. The female combined leg-plug-centerbody piece 710 includes a cone half angle $\alpha 1$ that may be in the range of about thirty-five degrees (35°) to about fifty-five degrees (55°), and includes an outer radius of curvature R31 and an inner radius of curvature R310, and has a wall thickness T1. Similarly, the male combined leg-plug-centerbody piece 712 has a cone half angle $\alpha 2$ that may be in the range of about thirty-five degrees (35°) to about fifty-five degrees (55<), an inner radius of curvature R320, a minimum wall thickness T2, and a conical outer surface with a cone half angle of $\beta 2$, which may be in the range of about thirty-five degrees (35°) to about fifty-five degrees (55°).

In the embodiment as shown in FIG. 7, the largest diameter D2 of the discharge chamber 702 is about 6.2 mm. The dimensions L31 and L32 represent the length of the female combined leg-plug-centerbody piece and the male combined leg-plug-centerbody piece, respectively, and the dimension $\alpha 1$ represents a cone half angle of the female combined leg-plug-centerbody piece and the dimension $\alpha 2$ represents a cone half angle of the male combined leg-plug-centerbody piece. The dimensions R41 and R42 represent the radius of curvature of the female combined leg-plug-centerbody piece and of the male combined leg-plug-centerbody piece, respectively, and the dimension L1 represents the distance between a first body-leg transition portion and a second body-leg transition portion. With regard to the dimensions shown in FIG. 7 and described above, the following relationships are true: 0.5<R3 /D2<1.1 and 0.5<R320/D2<1.1 and 0.8<R320/R 31<1.2 and T1/2<L31, L32<D2/2 and 0.04<R41/D2<0.5 and 0.1<R42/D2<0.5 and 1.3<L1/D2<2 and 35°<$\alpha 1$, $\alpha 2$, $\beta 2$<55°.

Even if a majority of HID or CMH lamps are labeled as "universal burning" types, the basic orientation of a CMH lamp is substantially "vertical base up" (VBU) within some tilt angle limits. Because of this, the upper end portion of a conventionally axially symmetric double-ended HID discharge chamber often becomes overheated by natural convection of the hot discharge gas, while the temperature of its lower end portion remains behind its optimum design value. In addition, the majority of HID lamp constructions are of the single-ended types with a single base, located at only one end of the lamp. This geometrical asymmetry of a single-ended lamp construction results in different degrees of back-heating of the two opposite end portions of a conventionally axially symmetric discharge vessel and its embedded axially symmetric discharge chamber by the heat reflected back from the base, which again leads to a final thermal asymmetry between the two chamber end portions. In addition, as a result of some special outer bulb geometries, there are HID lamp constructions where the thermal environment of the discharge vessel and its embedded discharge chamber is inherently highly asymmetric, again leading to an asymmetric temperature distribution of the geometrically axially symmetric discharge chambers. Examples of such lamp constructions are reflector lamps (PAR20, PAR30, MR16) having a small reflector cone angle, or lamps having built-in light blocking shields that reflect a considerable amount of heat (such as AR111 type lamps). In addition, geometrically tight parabolic or lighting fixture constructions can have the same effect on the discharge chamber temperature distribution. Under such conditions, the thermally axially asymmetric HID discharge chamber described herein may be advantageous because its inherent axial thermal asymmetry can be utilized to compensate for undesirable thermal differences from, for example, a thermally asymmetric orientation, lamp construction and/or fixture environment, and ultimately make the lamp a thermally optimized "universal burning" type lamp.

Figure 8:
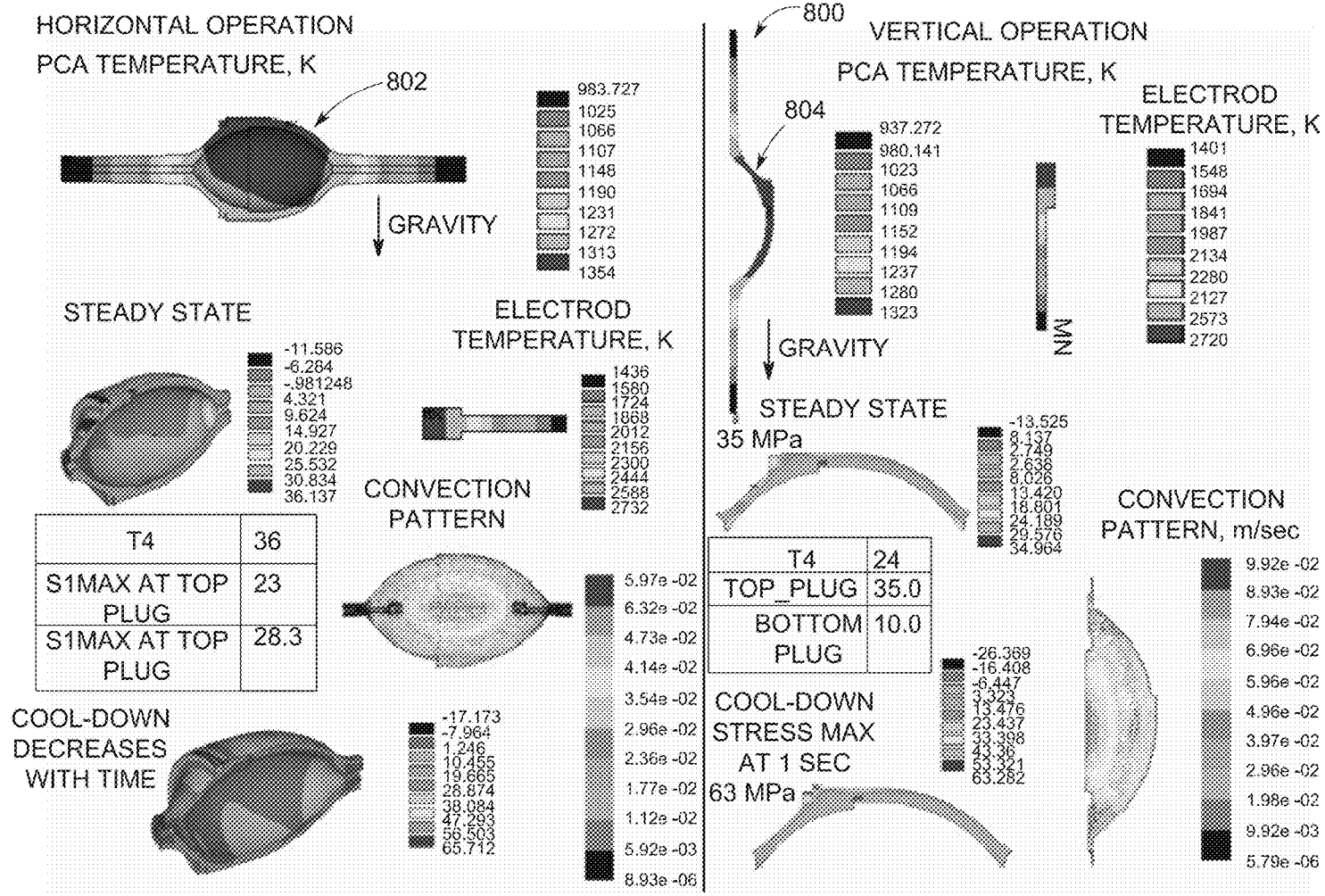
FIG. 8 depicts thermal imaging calibrated computer modeling data for a 70 Watt, two-piece, shaped CMH discharge vessel embedding an axially asymmetric discharge chamber in horizontal and vertical burn orientations according to aspects of the invention.
Figure 9:
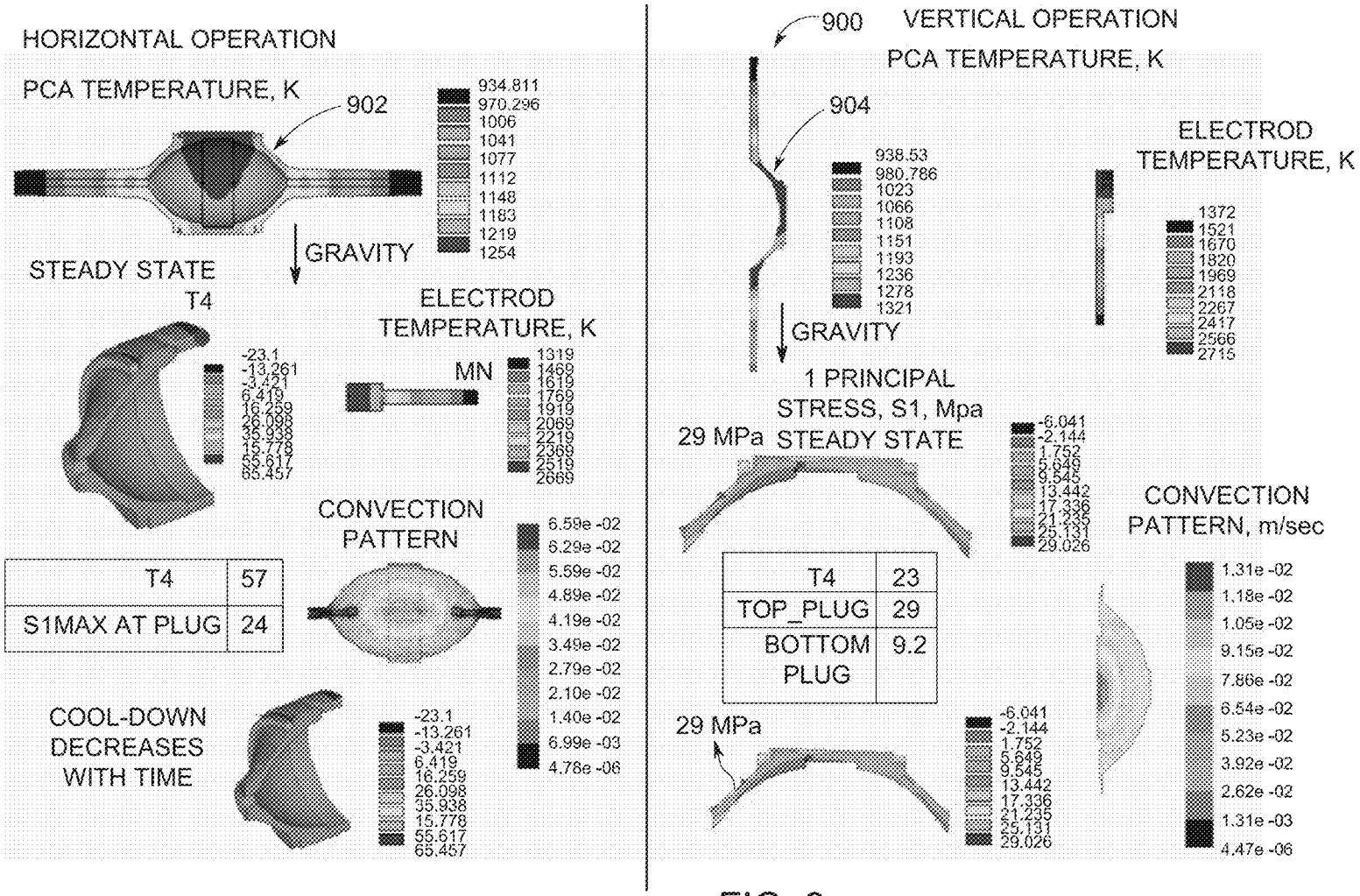
FIG. 9 shows thermal imaging calibrated computer modeling data for a conventional 70 Watt, three-piece, shaped HID CMH discharge vessel embedding an axially symmetric discharge chamber in horizontal and vertical burn orientations.

FIG. 8 illustrates thermal imaging and computer modeling aspects 800 of the axial thermal asymmetry of the two-piece, shaped HID CMH discharge vessel body 600 of FIG. 6B, which includes an embedded, axially asymmetric discharge chamber. In particular, the thermal imaging calibrated computer modeling results 800 of FIG. 8 include a steady-state and cool down thermal and stress analysis of a 70 Watt, two-piece CMH discharge vessel construction in horizontal and vertical burn orientations. In contrast, FIG. 9 shows thermal imaging calibrated computer modeling results 900 for a conventional three-piece, shaped HID CMH discharge vessel (similar to the discharge chamber of discharge vessel body 500 of FIG. 5B), which has an axially symmetric discharge chamber with the same "male" component geometry at both end portions. The computer modeling results 900 of FIG. 9 includes a steady-state and cool down thermal and stress analysis of a 70 Watt, three-piece, shaped and axially symmetric discharge vessel construction in horizontal and vertical burn orientations. The PCA and electrode temperatures of both of these discharge vessel constructions were within material limits, and stresses were well below the PCA strength of the designs. Thus, the thermal imaging calibrated computer modeling data shown in FIG. 9 can be used as reference for the data shown in FIG. 8.

Referring to FIGS. 8 and 9, the horizontal temperature distribution 802 shown in FIG. 8 indicates inherent axial thermal asymmetry of the axially asymmetric discharge chamber construction, whereas the horizontal temperature distribution 902 of FIG. 9 indicates axial thermal symmetry of the axially symmetric discharge chamber construction, as expected. However, the vertical orientation temperature distribution data 804 show a compensating effect due to the two-piece, shaped and axially asymmetric CMH discharge chamber made according to the present invention. In contrast, the vertical orientation temperature distribution data 904 illustrates a convection driven overheating effect of the upper end portion of the inherently axially symmetric three-piece, shaped CMH discharge chamber.

Thus, it should be understood that in an HID tamp having the inherent axially asymmetric temperature distribution of the two-piece, shaped and axially asymmetric CMH discharge chamber construction described herein can be used to compensate for the unavoidable thermal asymmetry observed in conventional axially symmetric discharge chambers due to operational orientation effects, or due to an axially asymmetric temperature environment resulting from a thermally asymmetric outer bulb or lighting fixture construction.

Figure 10:
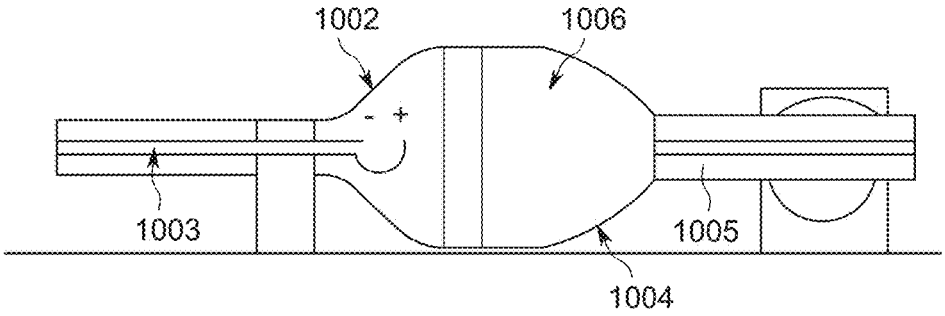
FIG. 10 shows an implementation of a two-piece, shaped HID CMH discharge vessel embedding an axially asymmetric discharge chamber in accordance with an embodiment of the invention.

FIG. 10 shows an embodiment of a two-piece, shaped HID CMH discharge vessel 1000 embedding an axially asymmetric discharge chamber in accordance with the present disclosure. A "male", first combined leg-plug component 1002 that includes a quasi-conical endplug portion and a leg portion with leg bore 1003 for an electrode, which was injection molded in one single piece, has been sintered to a "female", second leg-plug-centerbody component 1004 that includes a quasi-ellipsoidal shaped endplug portion and a leg portion with leg bore 1005, which was also injection molded in one single piece. By sintering, an axially asymmetric discharge chamber 1006 has been formed, and thus the CMH discharge vessel 1000 thus has an embedded axially asymmetric discharge chamber with an axially asymmetric temperature distribution characteristic.

Figure 11:
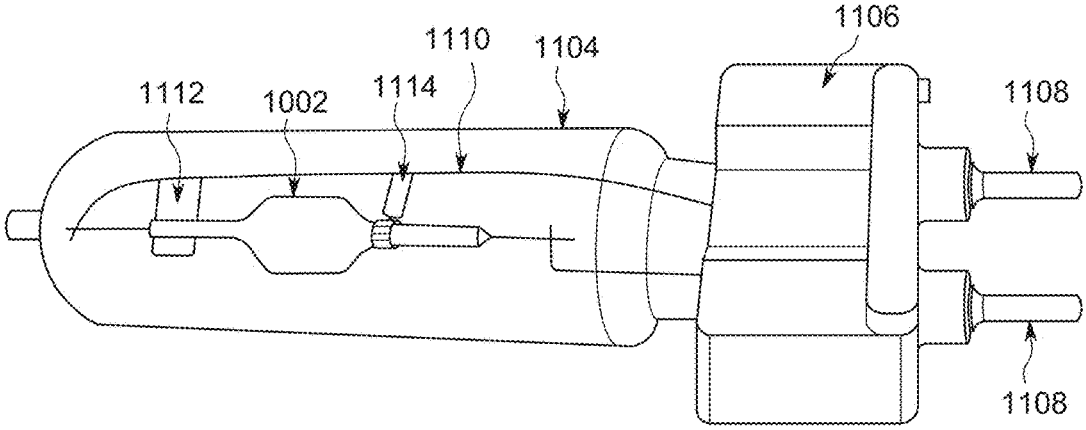
FIG. 11 illustrates an example of a "finished" HID CMH lamp with a G12 base single-ended construction that incorporates a two-piece, shaped HID CMH discharge vessel embedding an axially asymmetric discharge chamber according to an embodiment of the invention.

FIG. 11 illustrates a "finished" HID CMH lamp 1100 with a G12 base single-ended construction that includes a discharge vessel 1102 similar to the CMH discharge vessel 1000 of FIG. 10. An outer bulb 1104 encapsulates the discharge vessel 1102 and is connected to a G12 cap 1106 and contact pins 1108. Also included within the outer bulb 1104 are frame wires 1110, getter 1112 and a metal foil starting aid 1114.

Figure 12B:
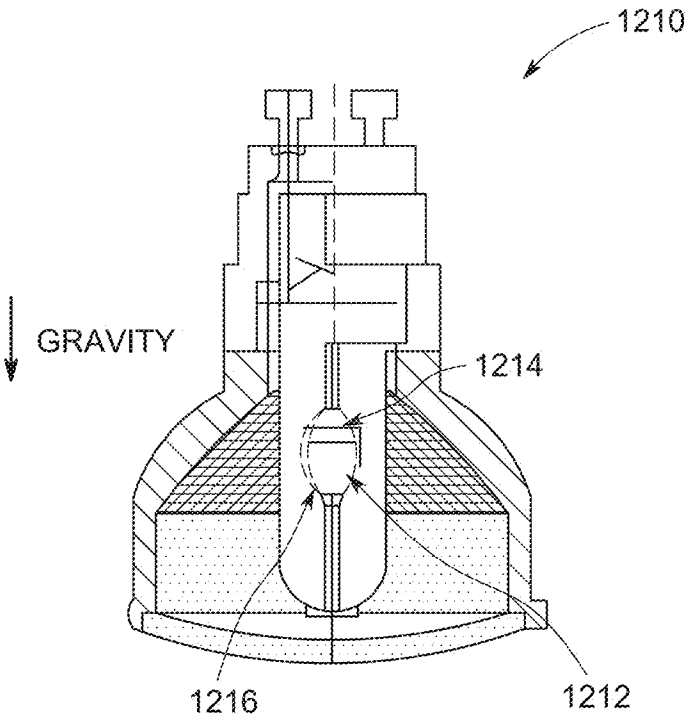
FIG. 12B illustrates an HID CMH lamp of an MR16 embodiment that includes a two-piece, shaped discharge vessel embedding an axially asymmetric discharge chamber in a vertical base up ("VBU") orientation in accordance with an embodiment of the invention.
Figure 12A:
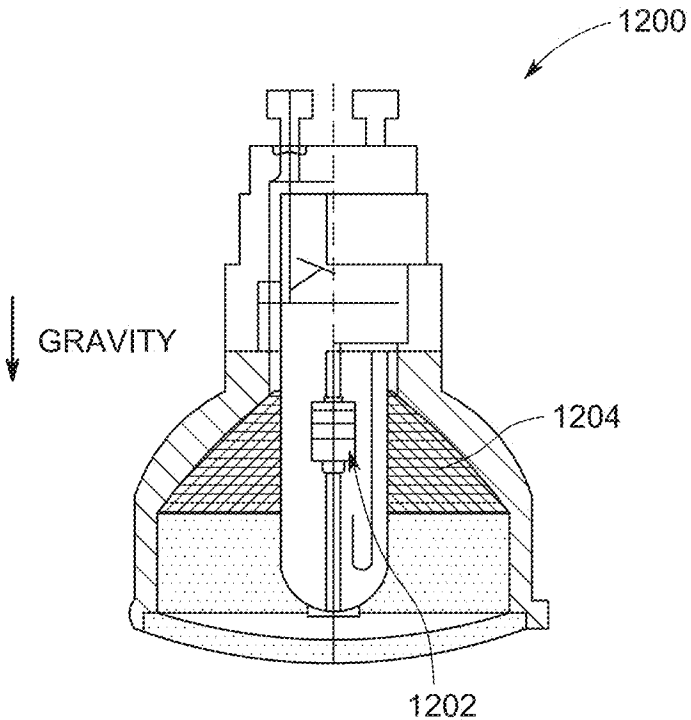
FIG. 12A PRIOR ART
FIG. 12A illustrates an HID CMH lamp of an MR16 embodiment that includes a conventional three-piece, "boxed-shaped" discharge vessel in a vertical base up ("VBU") orientation.

FIG. 12A illustrates an HID CMH lamp 1200 that includes a conventional three-piece "boxed-shaped" discharge vessel 1202 of axial chamber symmetry in a vertical orientation (for example, for use as a ceiling lamp), whereas FIG. 12B illustrates an HID CMH lamp 1210 that includes a two-piece, shaped discharge vessel 1212 embedding an axially asymmetric discharge chamber in a vertical orientation in accordance with embodiments described above. Referring to FIG. 12A, the lamp 1200 includes a mirror surface 1204 that reflects light and also heat back to the discharge chamber when the lamp is operating. When in a vertical orientation (as shown), the effect of back-heating by the mirror surface 1204 is stronger at the top portion of the discharge chamber, which is closer to the "neck" portion of the mirror surface 1204 and which has a considerably smaller diameter than the largest diameter of the mirror surface. In addition, vertical operation of the lamp 1200 also leads to additional heating of the top portion of the discharge chamber due to a buoyancy force driven upward convection of the discharge gas in the discharge chamber. As a consequence, the temperature of the conventional axially symmetric discharge chamber of the discharge vessel 1202 during operation near the top portion of the discharge chamber will be greater than the temperature near the bottom portion of the chamber, which adversely affects lamp performance and reliability. In contrast, with regard to FIG. 12B, the temperature during operation of the "male" portion 1214 of the axially asymmetric discharge chamber (now located at the top end of the center portion of the discharge vessel 1212) should inherently be colder (due to the built-in axially asymmetric temperature characteristic of the geometry of a discharge chamber construction according to the embodiments described herein) than that of the "female" portion 1216 (now located at the bottom end of the discharge chamber). Clearly, orientation and lamp construction characteristics, and built-in axial thermal asymmetry of the discharge chamber in accordance with the novel aspects described herein drive thermal asymmetry and final axial temperature distribution of the discharge chamber in opposite directions in this example. Consequently, a characteristic feature of the built-in axial thermal asymmetry of a discharge chamber made according to the present disclosure can be used to compensate for orientation and lamp construction driven thermal effects. In fact, in some embodiments the characteristic features of the built-in axial thermal asymmetry of the discharge chamber may even completely cancel out detrimental effects on lamp performance, to make the overall temperature distribution of the axially asymmetric discharge vessel symmetric under these circumstances.

Figure 13B:
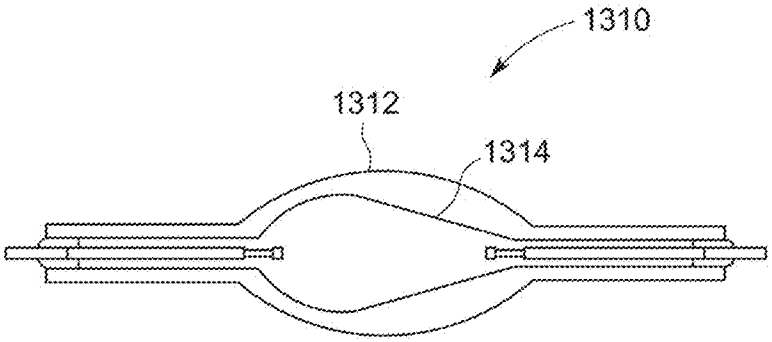
FIGS. 13A to 13D illustrate alternative implantation options for creating moderately axially asymmetric temperature distributions by introducing a specific axial asymmetry into the discharge chamber geometry in accordance with embodiments of the invention.
Figure 13D:
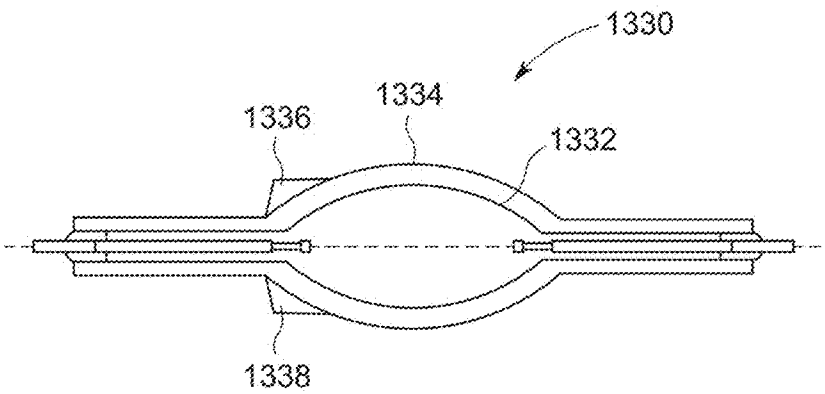
Figure 13A:
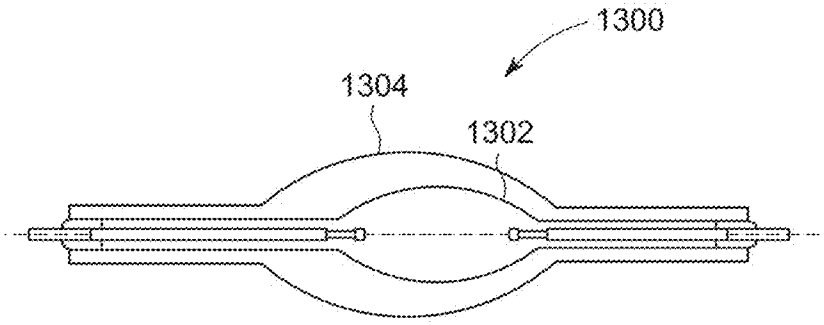

FIGS. 13A to 13D illustrate alternative options and/or implementations for creating moderate axially asymmetric temperature distributions by introducing specific axial asymmetry into the discharge chamber geometry. In particular, FIG. 13A illustrates a CMH discharge vessel construction 1300 which exhibits a discharge chamber of an axially symmetric inner contour 1302 and an axially symmetric outer contour 1304, but wherein an axially shifted inside geometry creates a wall thickness difference at opposite ends of the discharge chamber to thus create an axially asymmetric temperature distribution of the chamber.

FIG. 13B illustrates a CMH discharge vessel construction 1310 which exhibits a discharge chamber of an axially symmetric outside contour 1312 but which contains an axially asymmetric inside geometry 1314 to thus create walls of varying thickness and an axially asymmetric temperature distribution of the discharge chamber.

Figure 13C:
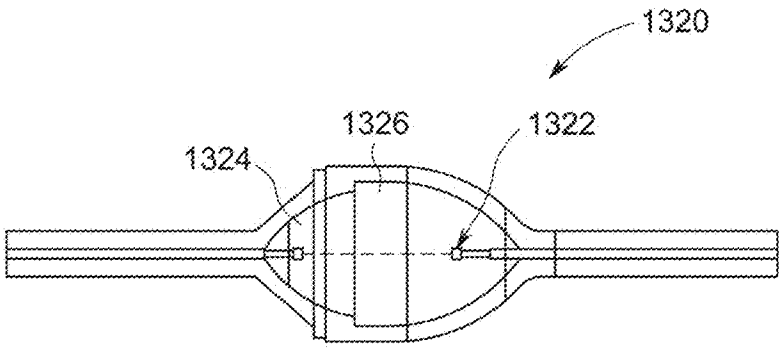

FIG. 13C illustrates a CMH discharge vessel construction 1320 of an axially asymmetric discharge chamber geometry which is an embodiment of the two-piece, shaped and axially asymmetric CMH discharge chamber construction described above, but this implementation includes an electrode tip 1322 extending further into the discharge chamber 1326 than that of the opposite electrode tip 1324 to reduce the built-in axial thermal asymmetry of the discharge chamber due to a shifting of the arc gap in axial direction. Thus, FIG. 13C illustrates a method for fine-tuning the axial thermal asymmetry of a particular CMH discharge chamber in accordance with embodiments described herein to address, for example, environmental and/or orientation issues.

FIG. 13D illustrates a CMH discharge vessel construction 1330 which exhibits a discharge chamber of an axially symmetric inside contour 1332 and an axially symmetric outside contour 1334, but includes cooling fins 1336, 1338 attached to the outside surface on one end of the discharge chamber 1330 to thus create an axially asymmetric temperature distribution of the chamber.

It should be understood that FIGS. 13A-13D illustrate some examples of geometric shapes and/or component possibilities, and other shapes and/or components are contemplated. In addition, some implementations may utilize or combine one or more features shown in FIGS. 13A-13D, for example, an embodiment of a CMH lamp may include the axially symmetric outside contour 1312 and axially asymmetric inside geometry 1314 shown in FIG. 13B along with the fins 1336, 1338 shown in FIG. 13D. Accordingly, an axially asymmetric temperature distribution of a proposed HID discharge chamber can be used to compensate for the unavoidable thermal asymmetry that is observable in conventional axially symmetric discharge chambers due to operational orientation effects, or due to an axially asymmetric temperature environment by a thermally, highly asymmetric outer bulb or lighting fixture construction.

The nominal power range of CMH lamps having discharge chamber geometry as described above can vary depending on the application. For example, CMH lamps for retail lighting applications may have a nominal operating power range of from about twenty watts (20 W) to about one-hundred and fifty watts (150 W), whereas CMH lamps for use in outdoor/high bay lighting may have a nominal operating power range of from about 35 W to about 800 W, and CMH lamps for use in sports lighting may have a nominal operating power range from about 1 kW to about 2 kW. Thus, the wall thickness characteristics of such lamps will also vary.

The technical advantages of the discharge chamber constructions described herein include providing improved universal burning characteristics of highly asymmetric lamp constructions. This results in improved reliability due to the avoidance of overheating of one end part of the discharge chamber, while under-heating the opposite end of the discharge chamber from a maximum achievable performance perspective. In addition, the methods described herein result in an optimized lamp construction. The two-piece, shaped HID CMH discharge vessel embodiment described herein that embeds an axially asymmetric discharge chamber retains reliable ceramic joint construction while using inexpensive ceramic shaping technology to result in a competitive product that performs as required at a competitive product cost It should be understood that the above descriptions and/or the accompanying drawings are not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. An arc tube assembly having an axially asymmetric outside geometry, comprising:

a combined leg-plug component comprising a quasi-conical endplug portion, a leg portion with a leg bore, and a cylindrical ledge portion with a circular stop; and a combined leg-plug-centerbody component comprising a leg portion with a leg bore, a quasi-ellipsoidal endplug portion, and a quasi-tubular centerbody portion comprising a tip portion for connection to the cylindrical ledge portion of the combined leg-plug component;

wherein the combined leg-plug component and the combined leg-plug-centerbody component define an axially asymmetric discharge chamber when co-sintered for enclosing a metal-halide dose in a vacuum-tight manner, and provide an axially asymmetrical temperature distribution, wherein a wall thickness distribution of the axially asymmetric discharge chamber varies to improve stability, stress and lighting features of a lamp comprising the arc tube assembly, the wall thickness being in a range from about 0.4 mm to about 2 mm.

2. The arc tube assembly of claim 1, wherein a wall of the resultant discharge chamber comprises a ceramic material.

3. The arc tube assembly of claim 1, wherein the leg portions of the combined leg-plug component and combined leg-plug-centerbody component are tapered.

4. An arc tube assembly having an axially asymmetric outside geometry, comprising:

a combined leg-plug component comprising a quasi-conical endplug portion, a leg portion with a leg bore, and a cylindrical ledge portion with a circular stop; and a combined leg-plug-centerbody component comprising a leg portion with a leg bore, a quasi-ellipsoidal endplug portion, and a quasi-tubular centerbody portion comprising a tip portion for connection to the cylindrical ledge portion of the combined leg-plug component;

wherein the combined leg-plug component and the combined leg-plug-centerbody component define an axially asymmetric discharge chamber when co-sintered for enclosing a metal-halide dose in a vacuum-tight manner, and provide an axially asymmetrical temperature distribution, the combined leg-plug-centerbody component comprises a ceramic body wall having a thickness T1 and a dimension D2 that represents a maximum diameter of the discharge chamber, a first curved end portion with a dimension R31 representing the outer radius of curvature and a dimension R310 representing an inner radius of curvature, a first conical portion after the first curved end portion wherein a dimension L31 represents the a length of the first conical portion and a dimension $\alpha$1 represents a cone half angle of the first conical portion, and a first body-leg transition portion having a first body-leg interface after the first conical portion wherein a dimension R41 represents the radius of curvature of the first body-leg transition portion;

wherein the combined leg-plug component comprises a minimum wall thickness T2, a second curved end portion with a dimension R320 representing an inner radius of curvature, a conical outer surface having a cone half angle of $\beta$2 and an inner curved portion, a second conical portion after the second curved end portion wherein a dimension L32 represents the a length of the second conical portion and wherein a dimension $\alpha$2 represent a cone half angle of the second conical portion, a second body-leg transition portion having a second body-leg interface after the second conical portion wherein a dimension R42 represents the radius of curvature of the second body-leg transition portion;

wherein a dimension L1 represents the distance between the first body-leg transition portion and the second body-leg transition portion; and wherein the following relationships are true: 0.5 <R31/D2 <1.1 and 0.5 <R320/D2 <1.1 and 0.8 <R320 /R31 <1.2 and T1/2 <L31 and L32 <D2/2 and 1.3 <L1/D2 <2 and 35° <α1, α2, β2 <55° .

5. The arc tube assembly of claim 4 wherein the following relationships are true: and 0.04 <R41/D2 <0.5 and 0.04 <R42/D2 <0.5.

6. A discharge lamp comprising:

a two-piece arc tube assembly having an axially asymmetric outside geometry and an axially asymmetric inside surface geometry, wherein the arc tube assembly comprises:

a combined leg-plug component comprising a quasi-conical endplug portion, a leg portion with a first leg bore, and a cylindrical ledge portion with a circular stop; and a combined leg-plug-centerbody component comprising a leg portion with a second leg bore, a quasi-ellipsoidal endplug portion, and a quasi-tubular centerbody portion comprising a tip portion for connection to the cylindrical ledge portion of the combined leg-plug component;

wherein the combined leg-plug component and the combined leg-plug-centerbody component define an axially asymmetric discharge chamber when co-sintered for enclosing a metal-halide dose in a vacuum-tight manner, and provide an axially asymmetrical temperature distribution;

a first electrode having a first electrode tip positioned within the first leg bore such that the first electrode tip extends inside the discharge chamber; and a second electrode having a second electrode tip positioned within the second leg bore such that the second electrode tip extends inside the discharge chamber and such that the second electrode tip is positioned a predetermined distance away from and opposite the first electrode tip, wherein the predetermined distance defines a distance between the first and second electrodes so that the second electrode being extended further into the axially asymmetric discharge chamber than the first electrode, and the predetermined distance is chosen for fine tuning of the axially asymmetrical temperature distribution.

7. The lamp of claim 6, wherein the first electrode tip and the second electrode tip are comprised of at least one of a tungsten material and a tungsten alloy material.

8. An arc tube assembly having an axially asymmetric outside geometry, comprising:

a combined leg-plug component comprising a quasi-conical endplug portion, a leg portion with a leg bore, and a cylindrical ledge portion with a circular stop; and a combined leg-plug-centerbody component comprising a leg portion with a leg bore, a quasi-ellipsoidal endplug portion, and a quasi-tubular centerbody portion comprising a tip portion for connection to the cylindrical ledge portion of the combined leg-plug component;

wherein the combined leg-plug component and the combined leg-plug-centerbody component define an axially asymmetric discharge chamber when co-sintered for enclosing a metal-halide dose in a vacuum-tight manner, and provide an axially asymmetrical temperature distribution, wherein the leg portions of the combined leg-plug component and combined leg-plug-centerbody component are tapered.

* * * * *